US008684853B2

(12) United States Patent
Peters et al.

(10) Patent No.: US 8,684,853 B2
(45) Date of Patent: Apr. 1, 2014

(54) RECREATIONAL DOCK SWING

(76) Inventors: Jake M. Peters, Hayden, ID (US); Michael K. Peters, Hayden, ID (US)

( * ) Notice: Subject to any disclaimer, the term of this patent is extended or adjusted under 35 U.S.C. 154(b) by 232 days.

(21) Appl. No.: 13/200,582

(22) Filed: Sep. 26, 2011

(65) Prior Publication Data

US 2013/0079168 A1 Mar. 28, 2013

(51) Int. Cl.
*A63G 1/28* (2006.01)
*A63G 9/16* (2006.01)

(52) U.S. Cl.
USPC ..... 472/32; 42/119

(58) Field of Classification Search
USPC ..... 472/19, 20, 29, 32–33, 118, 119, 472/121–123
See application file for complete search history.

(56) References Cited

U.S. PATENT DOCUMENTS

| | | | | |
|---|---|---|---|---|
| 1,174,407 | A | 3/1916 | Glenn | |
| 1,643,097 | A | 9/1927 | Stewart et al. | |
| 2,239,542 | A * | 4/1941 | Stanzel | 472/32 |
| 3,090,617 | A * | 5/1963 | Hjelte et al. | 482/143 |
| 3,595,570 | A | 7/1971 | Huff | |
| 3,599,973 | A | 8/1971 | Ahrens | |
| 3,726,521 | A | 4/1973 | Sidlauskas | |
| 3,981,500 | A | 9/1976 | Ryan | |
| 4,576,373 | A * | 3/1986 | Spieldiener et al. | 472/33 |
| 4,877,236 | A | 10/1989 | Shannon | |
| 4,896,878 | A | 1/1990 | Greenwood | |
| 4,978,120 | A * | 12/1990 | Greenwood | 472/18 |
| 5,064,191 | A * | 11/1991 | Johnson | 482/143 |

FOREIGN PATENT DOCUMENTS

WO WO 2007/114573 A1 10/2007

* cited by examiner

*Primary Examiner* — Kien Nguyen
(74) *Attorney, Agent, or Firm* — John S. Reid

(57) ABSTRACT

An apparatus includes a substantially vertical elongated mast and a substantially horizontal elongated boom which is supported by the mast proximate an upper end thereof. The boom can pivot independently about a substantially vertical first axis and a substantially horizontal second axis. The boom has a first end proximate the mast and a distal opposite second end. A gripping element, for gripping by a user of the apparatus while the user is supported thereby, depends from the boom proximate the second end thereof. An elastic biasing member operatively attached to the mast and the boom provides a biasing force to bias the boom toward a rest position and against downward movement of the second end of the mast. The biasing member allows a temporary downward movement of the second end of the boom due to sudden application of weight of a user's body when the user grasps the gripping element.

7 Claims, 18 Drawing Sheets

1000

RECREATIONAL DOCK SWING

TECHNICAL FIELD

The disclosures provided herein relate to recreational apparatus and more specifically to recreational dock swing devices.

BACKGROUND

Many types of recreational or amusement activities are known to recreation seekers. A portion of such activities involve the recreation seeker swinging through the air while suspended on a rope or the like. For many years, a popular practice has involved suspending a rope or the like from a tree or suitable structure that is near a body of water. A known recreational activity includes a recreation seeker swinging out over the body of water while grasping the rope before letting go to fall into the body of water.

Various detriments, however, can be associated with such known activities. For example, in some instances, a suitable tree or other structure may not be available near the desired body of water, or the water near a suitable tree or structure is not deep enough for the desired activity. Further examples of such detriments which can be associated with said activities include repetitiveness and/or lack of variety, which can lead to boredom.

The identification of problems, deficiencies, potential or actual benefits or advantages described herein are not admitted to be prior art.

DESCRIPTION OF THE DRAWINGS

Preferred forms, configurations, embodiments and/or diagrams relating to and helping to describe preferred aspects and versions of the inventions provided for herein are explained and characterized herein, often with reference to the accompanying drawings. The drawings, and all features shown therein, also serve as part of the disclosure of the inventions encompassed within the current document, whether described in text or merely by graphical disclosure alone. Such drawings are briefly described below.

DETAILED DESCRIPTION

The readers of this document should understand that the embodiments described herein may rely on terminology used in any section of this document and other terms readily apparent from the drawings and the language common therefor as may be known in a particular art, and such as known or indicated and provided by dictionaries. Dictionaries were used in the preparation of this document. Widely known and used in the preparation hereof are Webster's Third New International Dictionary (© 1993), The Oxford English Dictionary (Second Edition, © 1989), and The New Century Dictionary (® 2001-2005), all of which are hereby referenced for interpretation of terms used herein and for application and use of words defined in such references to more adequately or aptly describe various features, aspects and concepts shown or otherwise described herein using more appropriate words having meanings applicable to such features, aspects and concepts which are depicted or otherwise disclosed herein.

This document is premised upon using one or more terms with one embodiment that may also apply to other embodiments for similar structures, functions, features and aspects of the inventions. Wording used in the claims is also descriptive of the inventions, and the text and meaning of the claims and abstract are hereby incorporated by reference into the description in their entirety as originally filed. Terminology used with one, some or all embodiments may be used for describing and defining the technology and exclusive rights associated herewith.

The readers of this document should further understand that the embodiments described herein may rely on terminology and features used in any suitable section or other embodiments shown in this document and other terms readily apparent from the drawings and language common or proper therefor. This document is premised upon using one or more terms or features shown in one embodiment that may also apply to or be combined with other embodiments for similar structures, functions, features and aspects of the inventions and provide additional embodiments of the inventions.

The invention(s) provided for by this disclosure may include a number of different specific configurations, embodiments, and/or variations, some or all having different advantages or effects relative to features, operation and production.

Features shown on some of the illustrated and/or described versions may also be used on other embodiments if aspects of construction and use do not prevent such added configurations from being implemented according to this disclosure.

Figure 1:
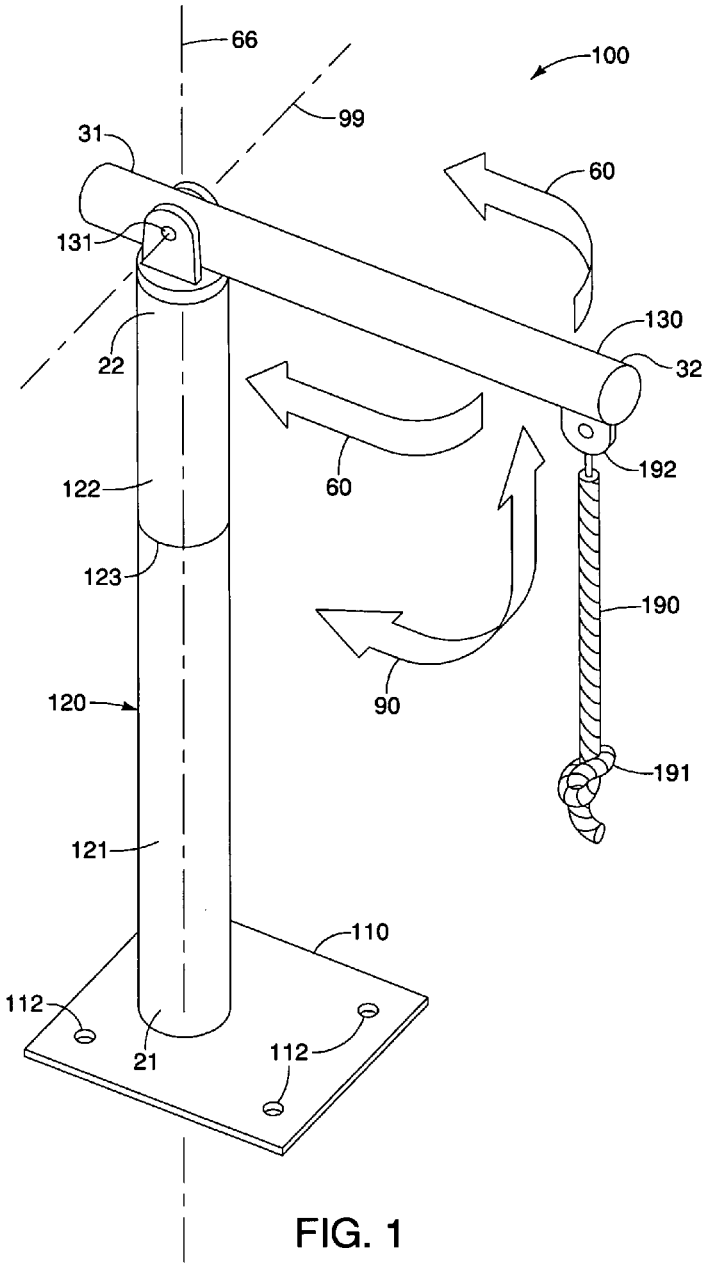
FIG. 1 is an isometric view of an apparatus according to an embodiment of the present disclosure.

With reference now to the drawings, FIG. 1 is an isometric view of an exemplary recreational swing apparatus 100. According to at least one embodiment of the present disclosure, the apparatus 100 is intended to be supported on a boat dock, raft, or other suitable support base so as to be near a body of water such as a lake. According to an exemplary use of the apparatus 100, a user of the apparatus grips one or more portions of the apparatus in a manner so as to swing from a dock or the like out over a body of water before dropping into the body of water for the purpose of amusement or recreation.

Primary components of the apparatus 100 include a base 110, a mast 120, a boom 130, and a gripping element 190. The base 110 is adapted to support other components of the apparatus 100. The base 110 can have one or more attachment features 112, which are adapted to facilitate mounting or attachment of the base to a support surface or structure such as a boat dock, raft, or the like. According to the exemplary embodiment of the apparatus 100, the base 110 is substantially in the form of a rigid structural plate, while the attachment features are in the form of a plurality of holes and/or slots passing through the base. More specifically, the base 110 can be, for example, a heavy plate made from metal including steel or aluminum, and the attachment features 112 can be in the form of apertures or openings adapted to allow fasteners such as bolts or the like to pass through the base to attach or mount the base to a support surface or support structure. It is to be understood that the base 110 and/or attachment features 112 can have numerous alternative configurations not specifically shown or described herein.

The mast 120 is elongate and is adapted to have a substantially upright or vertical orientation during use of the apparatus 100. The mast 120 has a lower end 21 and a distal upper end 22. The mast 120 is supported by the base 110 during use of the apparatus 100. The mast 120 extends substantially vertically from the base 110. The lower end 21 of the mast 120 is connected to the base 110, while the upper end 22 of the mast is distal from the base. The mast 120 includes one or more rigid structural elements. For example, the mast 120 includes a lower portion 121 and an upper portion 122. The lower portion 121 is supported by the base 110, while the upper portion 122 is supported by the lower portion. The upper portion 122 is adapted to rotate about a first axis 66 relative to the lower portion 121. The first axis 66 is substantially vertical when the apparatus 100 is in use. The first axis is coaxial with both the lower portion 121 and the upper portion 122 according to the exemplary embodiment of the present disclosure. A delineation or joint 123 separates or delineates the lower portion 121 of the mast 120 from the upper portion 122 thereof.

The lower portion 121 and the upper portion 122 can each be in the form of rigid structural elements. For example, each of the lower portion 121 and the upper portion 122 can be in the form of respective round, cylindrical members. The mast 120 or portions thereof 121, 122 can be made from steel, aluminum or other suitable structural material. It is to be understood, however, that the mast 120 and/or mast portions 121, 122 can have other specific forms and/or configurations not shown or described herein, and can be made from alternative materials. Furthermore, it is to be understood that the upper and lower portions 121, 122 can have relative sizes and/or lengths other than those depicted herein. Moreover, the upper and lower portions 121, 122 can have shapes and/or configurations other than those specifically depicted herein.

Still referring to FIG. 1, the boom 130 is supported by the mast 120 proximate the upper end 22 thereof. The boom 130 is elongate and has a first end 31 and a distal second end 32. The mast 120 supports the boom 130 proximate the first end 31 thereof, while the second end 32 is distal from the mast. The boom 130 can be in the form of a rigid structural element such as a round cylindrical member although other shapes and/or configurations are within the intended scope of the disclosure. The boom 130 can be made from steel, aluminum, although other suitable alternative materials can be used. It is to be understood that the boom 130 can have other specific forms and/or configurations that are not shown or described herein.

The boom 130 is adapted to pivot independently about the first axis 66 and a second axis 99. More specifically, the boom 130 is adapted to pivot or rotate about the first axis 66 relative to the base 110 as indicated by arrows 60, and is adapted to pivot about the second axis 99 relative to the mast 120 as indicated by arrow 90. As described previously, the first axis 66 is substantially vertical when the apparatus 100 is in use. As is seen from a study of FIG. 1, the second axis 99 is substantially horizontal when the apparatus 100 is in use. The pivoting capability of the boom 130 is independent with respect to the first axis 66 and the second axis 99 because the boom is adapted to pivot about the first axis without pivoting about the second axis, and vice versa. Alternatively, the boom 130 is also capable of pivoting about both the first axis 66 and the second axis 99 simultaneously. The boom 130 is adapted to pivot about the first axis 66 at a boom pivot joint 131.

The boom 130 is biased toward a rest position. The rest position is attained when no substantial external forces are acting upon the apparatus 100. For example, an external downward force can be applied to the second end 32 of the boom 130 to pivot the boom about the second axis 99 as indicated by the arrow 90. However, the boom 130 is biased so that when the external force is removed therefrom, the boom will return substantially to the rest position, which is depicted in FIG. 1 according to the exemplary embodiment of the present disclosure. In the normal, or rest, position the boom 130 is in a substantially horizontal position as depicted. However, in accordance with alternative embodiments of the present disclosure, the boom 130 can have an inclined orientation and/or can be oblique relative to the mast 120 when in the rest position.

The gripping element 190 depends from the boom 130 proximate the second end 32 thereof. The gripping element 190 is adapted to be gripped or grasped by a user of the apparatus 100. According to at least one embodiment of the present disclosure, the gripping element 190 is an inelastic flexible element. For example, the gripping element of the exemplary apparatus 100 is in the form of a heavy, coarse rope. However, it is to be understood that alternative gripping elements 190 can have other specific characteristics. For example, alternative gripping elements 190 can be substantially rigid or can be elastic. The gripping element 190 can have one or more gripping features 191 adapted to facilitate gripping or grasping. For example, the gripping feature 191 can be a large knot formed in the gripping element 190. The gripping element 190 can be attached to the boom by way of a connection 192. The connection 192 can have one of a number of forms such as a swivel joint or a pivot joint.

To use the apparatus 100, a user can run or walk along a surface upon which the apparatus 100 is supported before leaping upward to grasp the gripping element 190. Momentum of the user can be imparted to the apparatus 100 to cause the boom 130 to pivot about the first axis 66. Additionally, the sudden application of the user's mass to the boom 130 can cause the second end 32 of the boom to be temporarily depressed downward (pivoting about the second axis 99) as the user is moved out above a body of water adjacent to the apparatus 100. The boom 130, due to biasing thereof as described hereinabove, then returns toward the rest position whereupon the user can release his/her grasp of the gripping element to be thrown upward and outward into the body of water.

Figure 2:
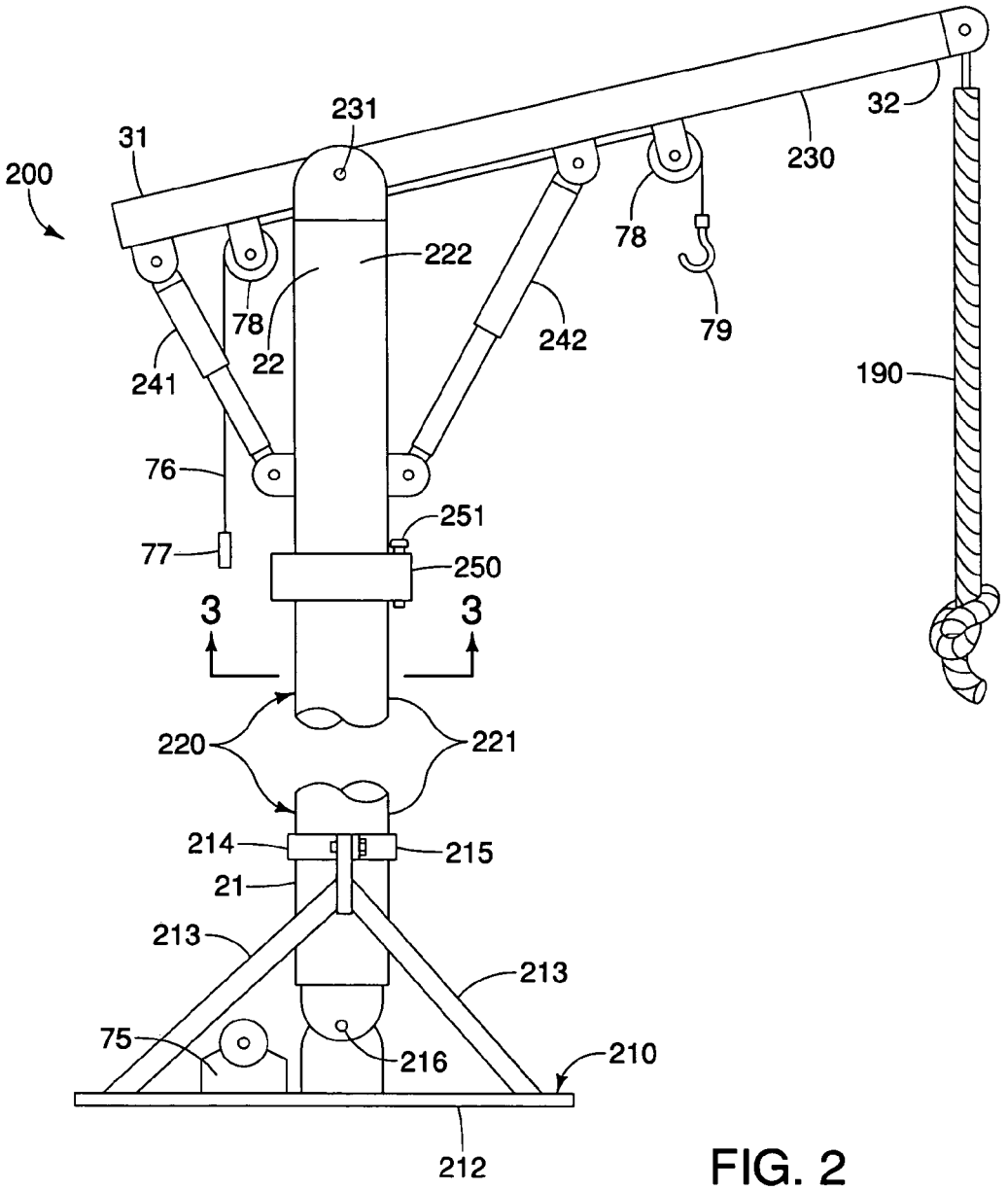
FIG. 2 is a side elevation view of an apparatus according to an embodiment of the present disclosure.

Turning now to FIG. 2 a side elevation view of an apparatus 200 is depicted according to at least one embodiment of the present disclosure. The apparatus 200 can be substantially similar in function and configuration to the apparatus 100 described herein with respect to FIG. 1. As shown in FIG. 2, the apparatus 200 has a base 210, a mast 220, and a boom 230, which can be substantially similar in function and/or configuration to, respectively, the base 110, mast 120 and boom 130 of the apparatus 100 (shown in FIG. 1). The base 210 can include a base plate 212 and one or more braces 213. The braces 213 are adapted to facilitate a substantially stable alignment and/or connection between the base plate 212 and the mast 220. The base 210 can include a bracket 214 that is adapted to contact the mast 220 for support thereof. The braces 213 can be connected to the base plate 212 and to the bracket 214. According to at least one embodiment of the present disclosure, the braces 213 are rigidly connected between the base plate 212 and the bracket 214.

The base 210 can include a pivot joint 216. The pivot joint 216 is adapted to enable the mast 220 to pivot relative to the base 210. For example, the pivot joint 216 can facilitate lowering of the mast for stowage and/or maintenance and/or repair. The mast 220 is supported by the pivot joint 216, which is supported by the base plate 212. To further facilitate pivoting of the mast 220 relative to the base 210, the bracket 214 can include a releasable portion 215. The releasable portion 215 of the bracket 214 is adapted to be openable or removable so as to enable disengagement of the mast 220 from the bracket 214.

With continued reference to FIG. 2, the boom 230 is adapted to pivot about a boom pivot joint 231. The apparatus 100 includes at least one biasing member 241, 242. At least one of the biasing members 241, 242 is adapted to bias the boom 230 toward a rest position thereof relative to the mast 220, and which rest position of the boom is depicted in FIG. 2. Specifically, for example, one or more of the biasing members 241, 242 can be adapted to bias the second end 32 of the boom 230 against downward movement. The biasing members 241, 242 can be connected to the mast 220 and to the boom 230. The biasing members can include one or more of a first biasing member 241 and a second biasing member 242. The first biasing member 241 can be a tension biasing member that is adapted to provide a biasing force between the mast 220 and the boom 230 while primarily under tension. The second biasing member 242 can be a compression biasing member that is adapted to provide a biasing force between the mast 220 and the boom 230 while primarily under compression. If an external force is applied to the boom 230 so as to move the second end 32 thereof in a downward direction, then the tension biasing member 241 will deflect by extending its length. Conversely, in such a situation, the compression biasing member 242 will deflect by shortening its length. Each of the biasing members 241, 242 can have one of a number of possible forms. For example, one or more of the biasing members 241, 242 can be substantially in the form of a mechanical spring, although alternative configurations and/or forms are contemplated.

The apparatus 200 can include a winch 75. The winch can be supported by the base 210. The winch 75 can be manually powered, or can be adapted to be powered by an external power supply. Included with the winch 75 is a winch line 76. The winch line can be, for example, a woven steel cable. The winch line 76 can be connected or coupled to the winch by way of a winch coupling 77. The winch line 76 can be supported from the boom 230 by way of one or more winch line supports 78. The winch line supports 78 can be in the form of pulleys or sheaves, for example, which are operatively attached to the boom 230. A winch line connector 79 can be included with the winch 75 as well. The winch line connector 79 can be in the form of a hook or the like. The winch line connector 79 is adapted to connect the winch line 76 to an object or person intended to be lifted by the winch 75. The winch 75 and related components can be employed for lifting handicapped persons between a dock and a watercraft, for example.

With further reference to FIG. 2, the upper portion 222 of the mast 220 is rotatable relative to the lower portion 221 thereof in the manner of the mast 120, which is described hereinabove with respect to FIG. 1. A study of FIG. 2 reveals that the apparatus 200 can include a mast stop, or horizontal stop, 250. The horizontal stop 250 is adapted to limit rotation of the upper portion 222 of the mast 220 relative to the lower portion 221 thereof. The horizontal stop 250 can be adjustable, wherein the rotational limit(s) of the mast 220 can be selectively adjusted or positioned as desired by the user. To facilitate such adjustment, the horizontal stop 250 can include one or more adjustable stop elements 251. A study of FIG. 2 reveals that view 3-3 is taken through the lower portion 221 of the mast 220 toward the upper portion 222 thereof.

Figure 3:
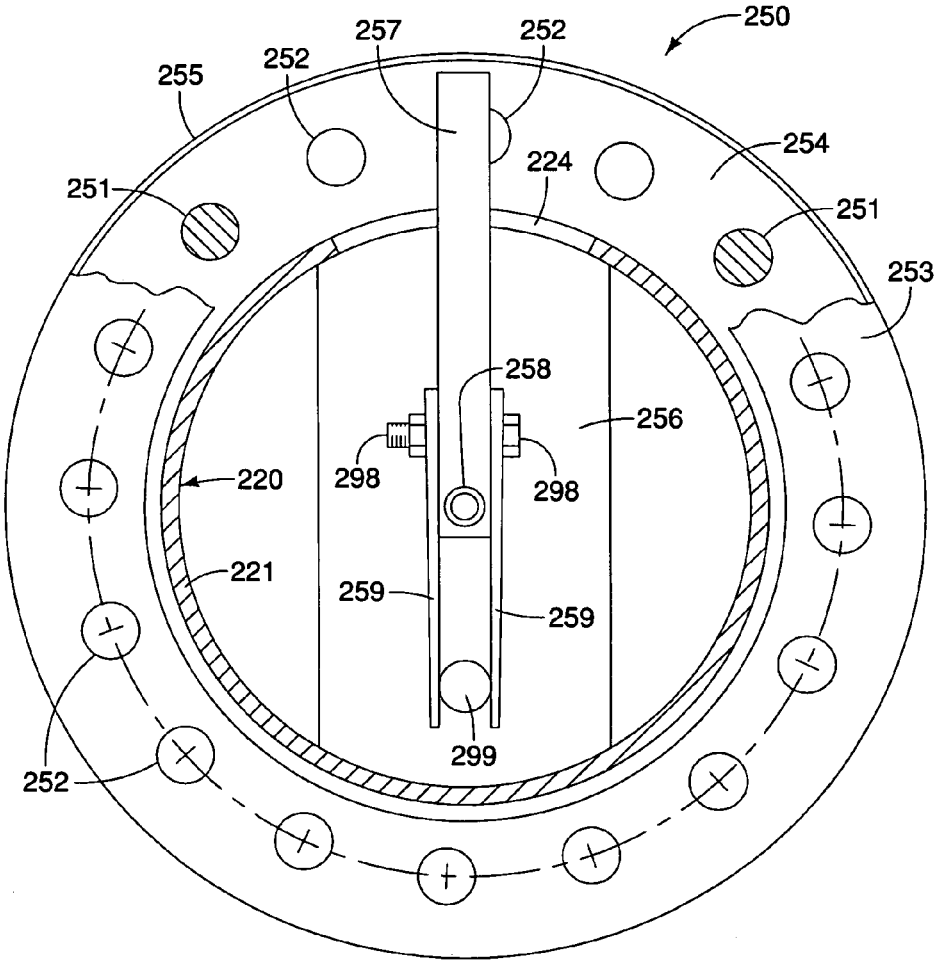
FIG. 3 is a sectional view of the apparatus depicted in FIG. 2.

Turning now to FIG. 3, a sectional view of the apparatus 200 is shown. As described previously, the sectional view of FIG. 3 is taken through the lower portion 221 of the mast 220 and toward the upper portion 222 (shown in FIG. 2) thereof. The view of FIG. 3 is in a direction that is coaxial or parallel with the mast 220. The view depicted in FIG. 3 serves as a detail view of the exemplary horizontal limit stop 250. The horizontal limit stop 250 includes a pair of flat rings, which are the lower ring 253 and the upper ring 254. A portion of the lower ring 253 is shown to be cut away in order to show the upper ring 254. The rings 253, 254 can be made from a durable structural material such as metal alloy (e.g. steel, aluminum) plate stock, although use of alternative materials is possible. Each of the rings 253, 254 defines an array of stop positions 252. As is depicted in FIG. 3, each of the stop positions 252 can be in the form of bore holes which pass through the respective upper and lower rings 253, 254. The stop positions 252 are substantially equally spaced about each respective ring 253, 254.

Still referring to FIG. 3, the upper ring 254 is attached to the upper portion 222 (shown in FIG. 2) of the mast 220. The upper ring 254 can be attached to the upper portion 222 of the mast 220 by a joining means such as welding. The upper ring 254 is positioned just above and adjacent to a delineation or separation (not shown) between the upper portion 222 of the mast 220 and the lower portion 253 thereof. The lower ring 253 is joined to the upper ring 254 by way of a side wall 255. That is, the side wall 255 extends between the upper ring 254 and the lower ring 253. The side wall 255 can be connected to the upper ring 254 and to the lower ring 253 by a joining means such as welding. The rings 253, 254 are of substantially identical sizes and are positioned in substantially parallel, juxtaposed orientation. The stop positions 252 on each of the rings 253, 254 are aligned so that each stop position on the lower ring is in juxtaposed orientation with a corresponding stop position on the upper ring. A stop element 251 in the form of a round pin, for example, can be placed through both the upper ring 254 and then the lower ring 253 as depicted in FIG. 3. One or both the stop elements 251 can be repositioned as desired in any of the stop positions 252.

The side wall 255 serves as a standoff or spacer between the rings 253, 254. The side wall 255 traverses a delineation (not shown) separating the lower portion 221 of the mast 220 from the upper portion 222 thereof. Thus, the upper ring 254 is located above, and substantially adjacent to, the delineation between the lower and upper mast portions 221, 222, while the lower ring 253 is suspended from the upper ring so as to be located below the delineation. The lower ring 253 has an inside diameter that is sized to provide a clearance between the lower ring and the lower portion 221 of the mast 220. The upper ring 254, the side wall 255, and the lower ring 253 are supported by the upper portion 222 of the mast 220. Thus, the upper ring 254, the side wall 255, and the lower ring 253 are rotatable along with the upper portion 222 of the mast 220 relative to the lower portion 221 thereof.

With continued reference to FIG. 3, the horizontal stop 250 includes a support member 256. The support member 256 is located within the mast lower portion 221, which can be in the form of a round, cylindrical tube, as depicted. The support member 256 can be in the form of a structural flat bar or channel or the like, and can be made from a structural material such as metal alloy. The support member 256 extends transversely across the inside of the mast lower portion 221, and can be connected thereto by joining means such as welding. The horizontal stop 250 includes a prime member 257. The prime member 257 is supported on the mast lower portion 221 and is adapted to contact one or more of the stop elements 251 to limit rotation of the mast upper portion 222 (not shown) relative to the mast lower portion. The prime member 257 can be in the form of a structural flat bar or beam. The prime member 257 can be made from a structural material such as metal alloy or the like.

The prime member 257 can be supported on the support member 256. A slot 224 can be defined through the mast lower portion 221, through which slot the prime member 257 extends, as depicted. The exemplary prime member 257 is resiliently deflectable. More specifically, the prime member 257 can be adapted to resiliently deflect or move in response to coming in contact with a stop member 251 during movement of the stop member relative to the prime member. The deflectable nature of the prime member 257 can serve to soften, or alleviate, otherwise sudden, jarring stops. The deflectable nature of the prime member 257 can be implemented by mounting the prime member 257 to the support member 256 by way of a pivot joint 258. The pivot joint 258 can be substantially in the form of an axle shaft or pin supported on the support member 256, and which passes through the prime member 257.

The horizontal stop 250 can include one or more resiliently deflectable elements 259. The deflectable elements 259 can be substantially in the form of leaf springs, as depicted. The deflectable elements 259 can be affixed to the prime member 257 by way of a fastener 298, for example. The deflectable elements 259 are thus pivotal about the pivot joint 258 along with the prime member 257. A bearing member 299 is affixed to the support member 256. The bearing member 299 can be a rigid structural member such as a length of round bar or a bolt. The bearing member 299 is in substantially parallel orientation relative to the pivot joint 258. As is seen from a study of FIG. 3, the bearing member 299 is positioned between the pair of deflectable members 259 of the exemplary horizontal stop 250. In this manner, pivoting movement of the prime member about the pivot joint 258 can result in impingement of a deflectable member 259 against the bearing member 299, which in turn can result in deflection of the deflectable member. Because of the resilient nature of the deflectable members 299, the prime member 257 will be biased toward a rest position, which is depicted in FIG. 3.

Figure 4:
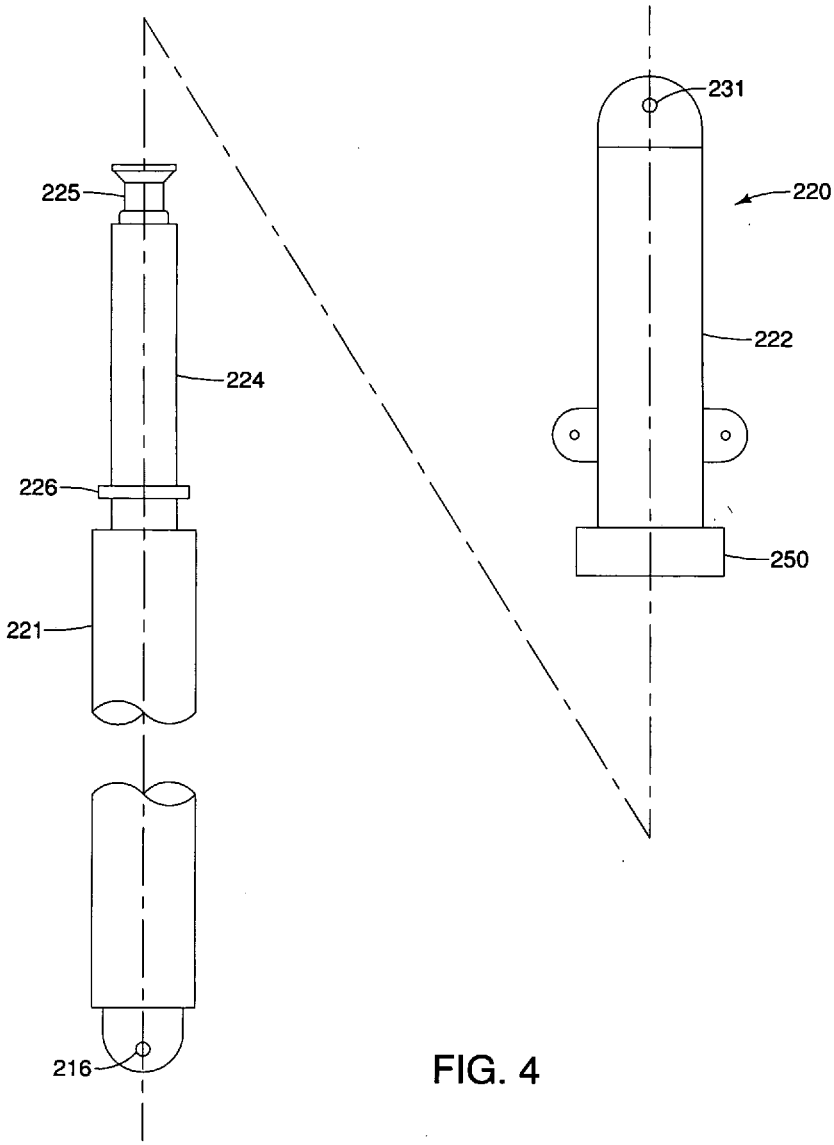
FIG. 4 is an exploded view of the mast of the apparatus depicted in FIG. 2.

Turning now to FIG. 4, an exploded view of the mast 220 of the apparatus 200 (shown in FIG. 2) is depicted. As is described above with respect to FIG. 2, the mast 220 includes a lower portion 221 and an upper portion 222. As is seen from a study of FIG. 4, the lower portion 221 can include a hub portion 224. The hub portion 224 extends axially from the lower portion 221. The hub portion 224 can be in the form of a structural element such as metal alloy tubing or the like. The hub portion 224 is preferably rigidly connected to the lower portion 221. The exemplary lower portion 221 can consist of two lengths of metal alloy tubing joined by welding, wherein the hub portion 224 is made from tubing that is smaller diameter than that of the remainder of the lower portion, as is depicted.

The hub portion 224 is adapted to fit within the upper portion 222 of the mast 220. That is, when the mast 220 is assembled, the upper portion 222 will cover the hub portion 224, thereby rending the hub portion hidden from view. The mast 220 includes one or more bearings 225, 226. The exemplary mast 220 includes two bearings, which consist of an upper bearing 225 and a lower bearing 226. The bearings 225, 226 are of a low-friction type which are adapted to facilitate substantially free rotation of the mast upper portion 222 relative to the lower portion 221. The bearings 225, 226 can have various forms including roller bearing assemblies, ball bearing assemblies, bushings, and journal bearings. Preferably, one of the bearings 225, 226 is adapted for thrust bearing capability, while the other bearing is adapted for radial bearing capability. For example, the upper bearing 225 can be a thrust bearing, while the lower bearing 226 can be a radial bearing, or vice versa.

Figure 5:
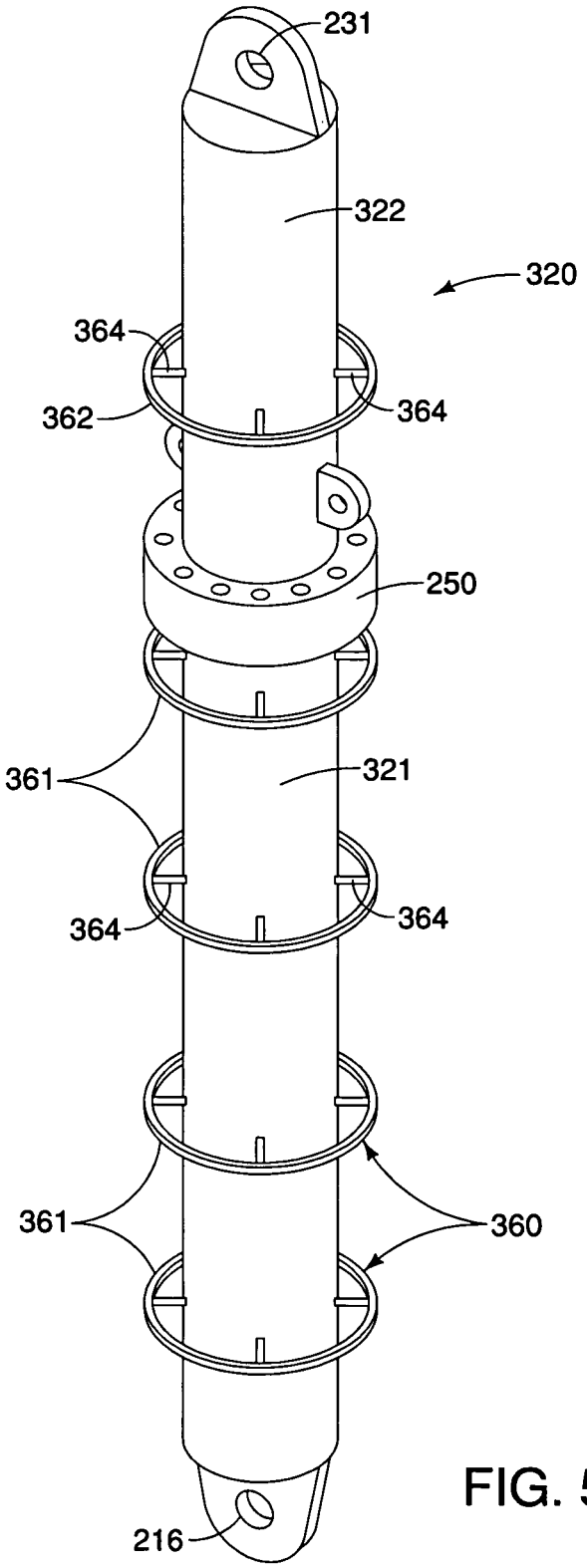
FIG. 5 is a detail isometric view of an alternative mast configuration.

Turning now to FIG. 5, a detail isometric view of an alternative mast assembly 320 is shown. The mast 320 can be substantially similar to the mast 220 described above with respect to FIGS. 2-4. Specifically, the lower portion 321 of the mast 320 (shown in FIG. 5) can be substantially similar to the lower portion 221 of the mast 220 (shown in FIGS. 2 and 4). Similarly, the upper portion 322 of the mast 320 (shown in FIG. 5) can be substantially similar to the upper portion 222 of the mast 220 (shown in FIGS. 2 and 4). However, as shown in FIG. 5, the mast 320 can be distinguished by the inclusion of a climbing aid, or ladder, 360. The climbing aid 360 is configured to facilitate climbing of the mast 320. It can be desirable to climb the mast 320 for a variety of reasons, such as for the purpose of maintaining or repairing various components, or for the purpose of facilitating use of an apparatus comprising the mast.

The climbing aid or ladder 360 can include a plurality of rungs 361, 362. The rungs can include at least one lower rung 361 and at least one upper rung 362. One or more lower rungs 361 are supported by the mast lower portion 321. Similarly, one or more upper rungs 362 are supported by the mast upper portion 322. The lower rungs 361 and the upper rungs 362 can be supported by the mast lower portion 361 and upper portion 362, respectively, by way of standoffs 364. More specifically, one or more standoffs 364 can extend between each of the mast portions 321, 322, and a respective rung 361, 362. According to the exemplary embodiment of the disclosure shown in FIG. 5, the rungs 361, 362 are substantially in the form of circular rings that circumscribe the respective mast portions 321, 322. The circular ring configuration of the rungs 361, 362 can facilitate climbing the mast 320 from any side thereof, and can facilitate climbing the mast regardless of the rotational orientation of the upper portion 322 relative to the lower portion 321. Additionally, the upper rung 362, by way of its ring configuration, can be employed as a handle to facilitate rotation of the upper portion 322 to a desired position relative to the lower portion 321.

Figure 6:
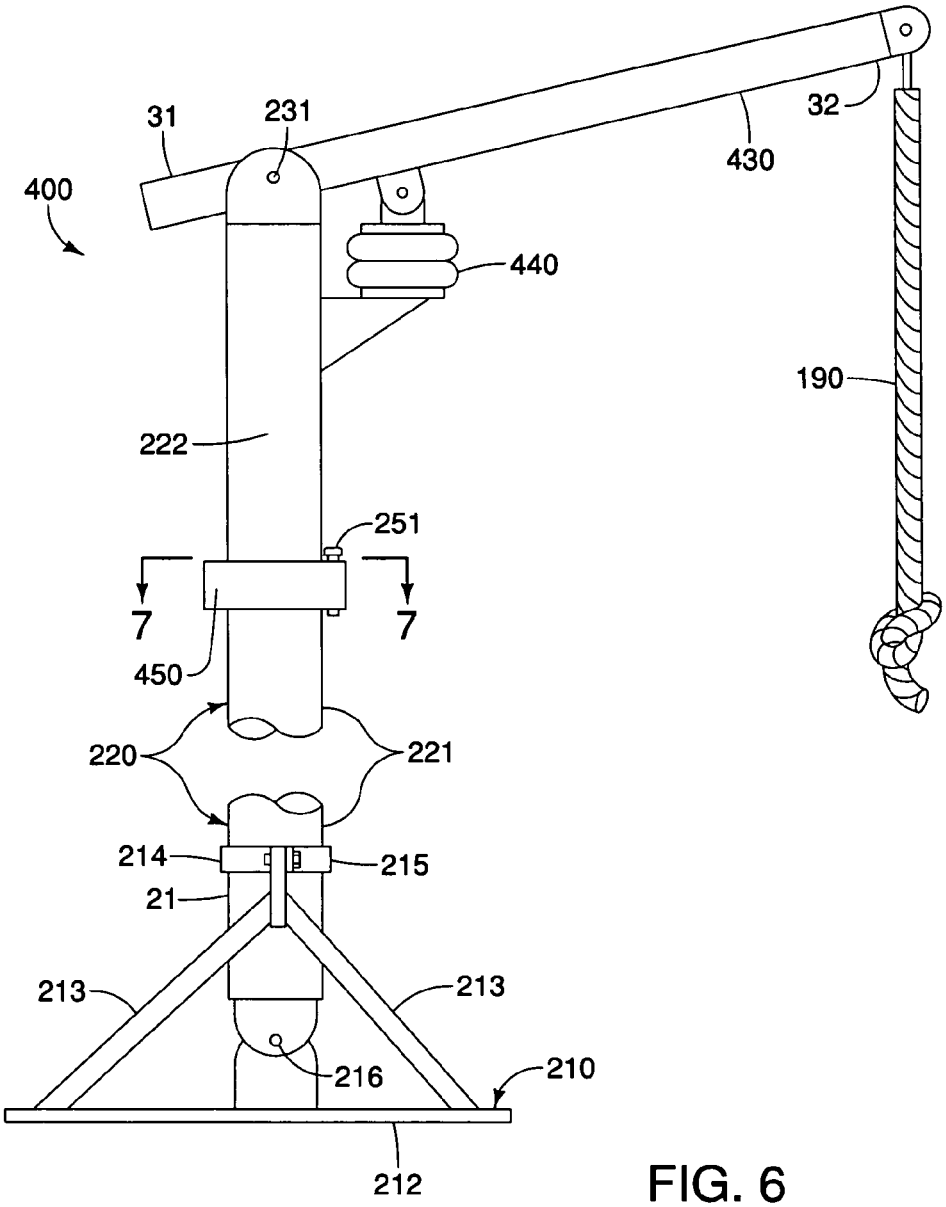
FIG. 6 is a side elevation view of an apparatus according to an alternative embodiment of the present disclosure.

Turning now to FIG. 6, a side elevation view of an apparatus 400 is depicted. The apparatus 400 can be substantially similar to the apparatus 200 described above with respect to FIG. 2, with several differences as described herein with respect to FIG. 6. The primary differences between the apparatus 200 (shown in FIG. 2) and the apparatus 400 depicted in FIG. 6 are in regard to the boom 430 and the biasing member 440. The boom 430 is shorter than the boom 230 (shown in FIG. 2). The biasing member 440 (shown in FIG. 6) is of one or more configurations different from that of the biasing members 241, 242 of the apparatus 200 (shown in FIG. 2). According to at least one embodiment of the present disclosure, the biasing member 440 is a pneumatic spring adapted to provide a primarily compressive biasing force. For example, the biasing member 440 can be in the form of a pliable air spring or air bag. According to an alternative embodiment of the present disclosure, the biasing member 440 includes a solid block of resiliently deformable material such as rubber, polyurethane or compressed synthetic rubber. An example of compressed synthetic rubber is vulcanized polybutadiene.

Figure 7:
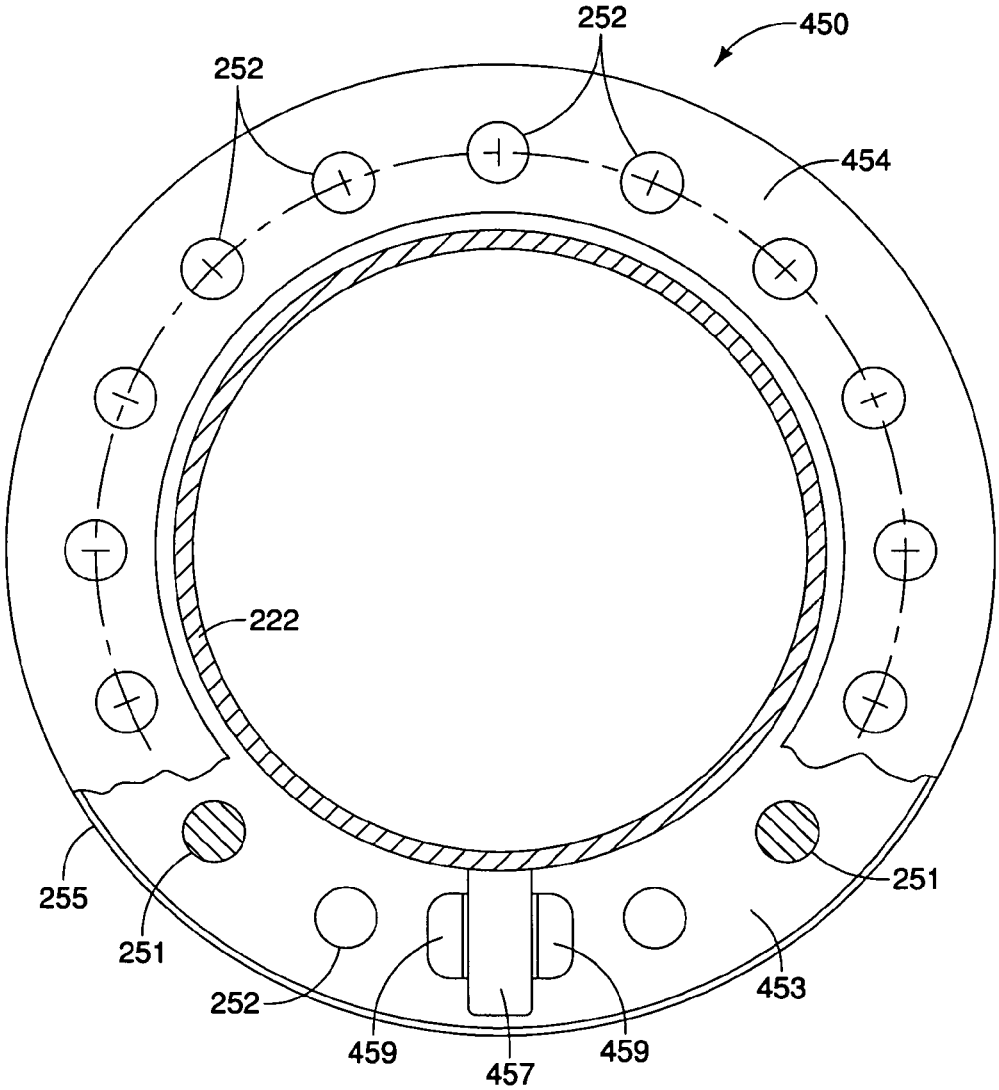
FIG. 7 is a sectional view of the apparatus shown in FIG. 6.

The apparatus 400 can include a horizontal stop 450, which is substantially similar to the horizontal stop 250 described above with respect to FIG. 3, with differences as noted hereinbelow. A section 7-7 is taken through the upper portion 222 of the mast 220, and toward the lower mast portion 221. The sectional view 7-7 is shown in FIG. 7 of the drawings. With reference to FIG. 7, the horizontal stop 450 includes a lower ring 453, an upper ring 454, a side wall 255, a primary member 457, and one or more deflectable members 459. The lower ring 453 and the upper ring 454 can be substantially similar to the lower ring 253 and the upper ring 254 described herein with respect to FIG. 3, except as noted. Specifically, with reference to FIG. 7, the lower ring 453 is joined to the lower mast portion 221 (not shown), while the upper ring 454 is configured to provide a clearance with the mast upper portion 222 in order to facilitate rotation of the mast upper portion within the upper ring. That is, the lower ring 453 is supported by the mast lower portion 221, and the upper ring 454 is supported by the side wall 255, which is in turn supported by the lower ring. Thus, the lower ring 453, the upper ring 455 and the side wall 255 remain stationary with the mast lower portion 221 (not shown), while the mast upper portion 222 is adapted to rotated with respect thereto.

Further study of FIG. 7 reveals that the horizontal stop 450 includes a prime member 457, which is affixed to the mast upper portion 222. A respective deflectable member 459 is supported on each side of the primary member 457, as shown. The primary member 457 can be, for example, a length of structural material such as a length of flat bar made from metal alloy. The primary member 457 can be connected to the mast upper portion 222 by joining means such as welding. Thus, the primary member 457 and deflectable members 459 are rotatable with the mast upper portion 222 relative to the upper and lower rings 453, 454, which are supported by the stationary mast lower portion (not shown). One or more selectively adjustable stop elements 251 can be placed in one or more of the plurality of stop positions 252 to achieve desired rotation limits of the mast upper portion 222 relative to the mast lower portion (not shown). That is, the stop elements 251 will remain stationary while the primary member 457 and deflectable members 459 rotate along with the mast upper portion 222. A rotational limit of the mast upper portion 222 is reached when either of the deflectable members 459 comes into contact with a respective stop element 251.

Figure 17:
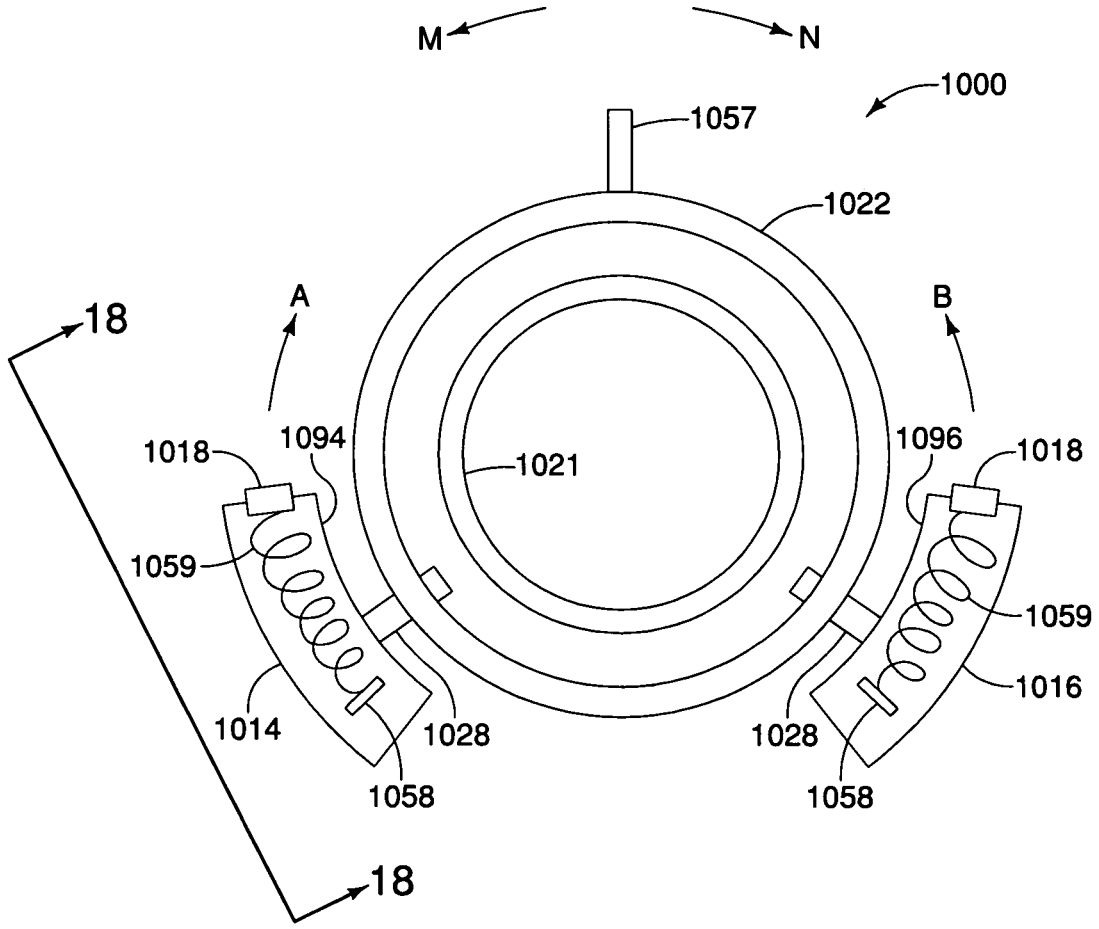
FIG. 17 is a sectional view of a mast and horizontal stop device of an apparatus according to an alternative embodiment of the present disclosure.
Figure 18:
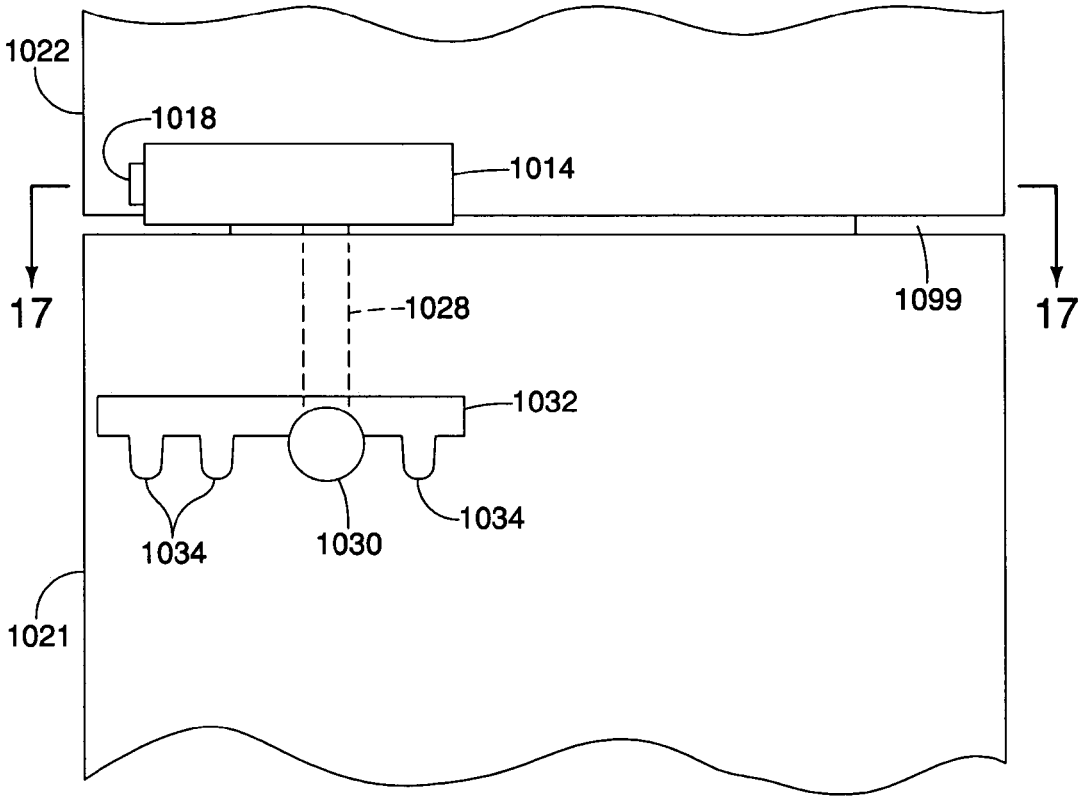
FIG. 18 is a partial side elevation view of the mast and horizontal stop device depicted in FIG. 17.

With reference now to FIGS. 17 and 18, a sectional view and a partial elevation view, respectively, depict a horizontal stop according to an alternative embodiment of the present disclosure. More specifically, the sectional view of FIG. 17 is taken along the sectional lines 17-17 (shown in FIG. 18), while the side elevation partial view of FIG. 18 is taken in the directional lines 18-18 (shown in FIG. 17). An apparatus 1000 includes a mast lower portion 1021 and a mast upper portion 1022, each of which can be substantially similar in function and/or configuration to the respective mast portions of one or more apparatus described and depicted herein. A gap 1099 is defined between the mast upper portion 1022 and the mast lower portion 1021.

The mast upper portion 1022 is supported by, and rotates relative to, the mast lower portion 1021. The mast lower portion 1021 is substantially stationary relative to the earth. More particularly, the mast lower portion 1021 can be supported by a base (not shown), which in turn is supported on a structure such as a dock or a raft or the like in the manner of mast lower portions of one or more other apparatus described and depicted herein. With reference to FIG. 17, the apparatus 1000 includes a prime member 1057. According to the exemplary embodiment of the disclosure, the prime member 1057 is selectively supportable on the mast upper portion 1022. More particularly, the prime member 1057 is adapted to be temporarily rigidly supported by the mast upper portion 1022 so as to extend normally therefrom in the manner depicted. That is, the prime member 1057 can be adapted to be removed from the mast upper portion 1022 as desired. The prime member 1057 can have a substantially elongated form, as shown. The prime member 1057 can be made from a structural material such as steel or aluminum alloy or the like. By way of example only, the prime member 1057 can be substantially in the form of a pin or dowel that is adapted to be removably inserted into a retainer receptacle (not shown) that is formed in the mast upper portion 1022. The prime member 1057 is adapted to rotate, along with the mast upper portion 1022, in directions indicated by arrows marked "M" and "N."

Still referring to FIG. 17, the apparatus 1000 includes a first spring support 1014 and a second spring support 1016. The spring supports 1014, 1016 are adapted to support respective springs 1059. The springs 1059 can be in the form of coil springs, as is depicted. More particularly, the springs 1059 can be in the form of compression springs. According to at least one embodiment of the present disclosure, the spring supports 1014, 1016 are in the form of housings in which the respective springs 1059 are housed, or substantially captured. According to the exemplary embodiment of the present disclosure, the spring supports 1014, 1016 are substantially in the form of tubes, each having a substantially circular cross section. The spring supports 1014, 1016 can have a substantially arcuate form so as to substantially match the curvature of the outer circumference of the mast upper portion 222 and mast lower portion 221, as shown. Each spring support 1014, 1016 has a respective inner side 1094, 1096. Each inner side 1094, 1096 is substantially open along its length according to the exemplary embodiment of the present disclosure.

The apparatus 1000 can include at least one spring anchor 1058. The spring anchor 1058 can be affixed to, and located within, the respective spring housing 1014, 1016. Moreover, one end of each spring 1059 can be attached to a respective spring anchor 1058. Alternatively, the spring anchors 1058 can be omitted, in which case the spring supports 1014, 1016 can be configured to operatively contain therewithin the springs 1059. The apparatus 1000 also includes at least one stop member 1018, wherein each stop member is associated with a respective spring support 1014, 1016. Each stop member 1018 is moveable relative to the respective spring support 1014, 1016. Each stop member 1018 is attached to an end of the respective spring 1059, as shown. In this manner, each stop member 1018 is movable into and along the length of the respective spring support 1014, 1016 as the associated spring 1059 is compressed. More particularly, as the mast upper portion 1022 rotates in direction M, the prime member 1057 will eventually come into contact with the stop member 1018 associated with the first spring support 1014. Similarly, if the mast upper portion 1022 rotates in the direction N, the prime member 1057 will eventually come into contact with the stop member 1018 associated with the second spring support 1016.

When the prime member 1057 comes into contact with a given stop member 1018, the given stop member will move into and along the respective spring support 1014, 1016 as the associated spring 1059 is compressed. The prime member 1057 can pass along the length of each spring support 1014, 1016 by way of the respective open inner side 1094, 1096. Each spring 1059 is generally compressed to a degree substantially proportionate to the speed and/or momentum with which the prime member 1057 contacts the associated stop member 1018. In this manner, rotation of the mast upper portion 1022 can be progressively slowed to a stop by contact of the prime member 1057 with one of the stop members 1018 and by compression of the associated spring 1059. Thus, sudden deceleration of the mast upper portion 1022 relative to the mast lower portion 1021 can be substantially avoided. Alternatively, the prime member 1057 can be removed from its supported position on the mast upper portion 1022, in which case the mast upper portion is adapted for substantially free and/or unlimited rotation relative to the mast lower portion 1021.

Turning now to FIG. 18, at least one slot 1032 is defined through the mast lower portion 1021. Each slot 1032 is associated with a respective spring support, such as the first spring support 1014. The slot 1032 has a substantially circumferential orientation relative to the mast lower portion 1021. The slot 1032 can have any of a number of possible lengths. According to the exemplary embodiment of the present disclosure, the slot 1032 has a length that is slightly greater than the length of the associated spring support, such as the first spring support 1014. Each slot 1032 has a plurality of associated indents 1034 that extend substantially downwardly from the slot, as shown. The exemplary slot 1032 depicted in FIG. 18 has four such indents 1034.

Still referring to FIG. 18, the apparatus 1000 includes at least one handle or knob 1030. According to the exemplary embodiment of the present disclosure, a single knob 1030 is associated with each spring support 1014, 1016. The apparatus 1000 also includes a single connecting member 1028 associated with each spring support 1014, 1016. Each connecting member 1028 is connected to, and extends between, the associated knob 1030 and the associated spring support 1014, 1016. More particularly, and with reference to both FIGS. 17 and 18, the connecting member 1028 extends from the associated knob 1030 inwardly through the associated slot 1032, thence upwardly to the gap 1099, thence outwardly through the gap before connecting with the associated spring support 1014, 1016. A portion of the connecting member 1028 is adapted to rest in a substantially cradled position within any of the indents 1034 of the associated slot 1032. Each of the spring supports 1014, 1016 can be positioned along the length of the associated slot 1032 to thereby selectively adjust the location at which the prime member 1057 contacts the associated stop member 1018. Such selective positioning of a given spring support 1014, 1016 can be accomplished by grasping the associated knob 1030 and moving the knob along with the associated connecting member 1028 and spring support 1014, 1016 to a desired position corresponding with an associated indent 1034 along the slot length. With reference to FIG. 17, each of the first spring support 1041 and the second spring support 1016 are adapted to be independently positioned in directions indicated by arrows marked "A" and "B", respectively.

Figure 8:
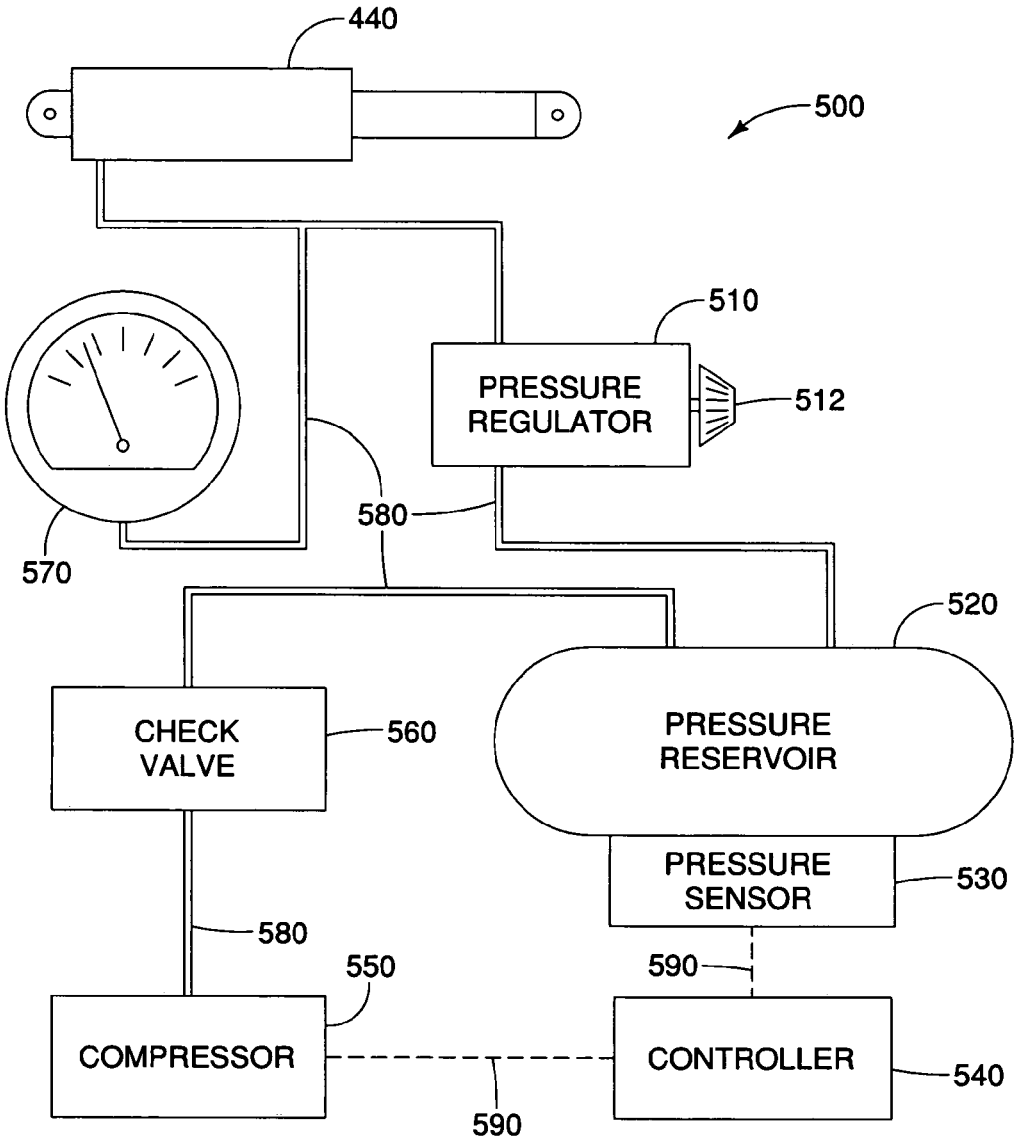
FIG. 8 is a diagrammatic view of a pneumatic system according to an embodiment of the present disclosure.

Turning now to FIG. 8, a diagrammatic view of a pneumatic system 500 is shown. The pneumatic system 500 can be used in conjunction with a pneumatic biasing member 440, which is described herein with respect to FIG. 6. According to at least one embodiment of the present disclosure, the pneumatic system 500 can be used to supply operating air pressure to the pneumatic biasing member 440 (also shown in FIG. 6). With reference to FIG. 8, the pneumatic system 500 can be employed to adjust pneumatic operating pressure within the pneumatic biasing member 440, according to one or more embodiments of the present disclosure.

The pneumatic system 500 can include one or more of a pressure regulator 510, a pressure reservoir 520, a pressure sensor 530, a controller 540, a compressor or compressed air source 550, a check valve 560, a pressure gauge 570, air line 580, and one or more signal links 590. The compressor or compressed air source 550 is adapted to provide compressed air to the pneumatic biasing member 440 by way of the air line 580. A pressure regulator 510 is adapted to control the operating air pressure within the pneumatic biasing member 440. The pressure regulator 510 is equipped with an input control 512. The pressure reservoir 520 can be employed to accumulate or store pneumatic pressure to be supplied to the pneumatic biasing member 440. The pressure reservoir 520 can be in the form of a compressed air storage tank, for example. The check valve 560 is adapted to allow compressed air to be supplied to one or more components of the system 500 while substantially preventing escape therefrom of compressed air. The pressure gauge 570 is adapted to display a pressure reading in order to facilitate monitoring of pneumatic pressure within the pneumatic biasing member 440. The pressure sensor 530 is adapted to monitor pneumatic pressure within the pressure reservoir 520 and to send a pressure data signal to the controller 540. The controller 540 is adapted to receive and read the pressure data signal sent from the pressure sensor 530. The controller 540 is also adapted to control output of the compressor 550 as a function of the pressure data signal received from the pressure sensor 530.

According to the exemplary system 500, the compressor 550 is adapted to provide compressed air to the pressure reservoir 520. The check valve 560 is positioned between the compressor 550 and the pressure reservoir 520 in order to allow compressed air to flow into the reservoir, while substantially preventing backflow of compressed air from the reservoir to the compressor. The pressure sensor 530 monitors air pressure within the reservoir 520 and is adapted to send a low pressure signal to the controller 540 if a predetermined level of low pressure in the reservoir is sensed. The controller 540, in response to receiving the low pressure signal from the sensor 530, transmits a "run" signal to the compressor 550, which causes the compressor to supply compressed air to the reservoir 520. The pressure within the reservoir is allowed to build until a predetermined level of high pressure is sensed by the sensor 530. The high pressure reading by the sensor 530 results in a high pressure signal being sent from the sensor to the controller 540. The controller 540, in response to receiving the high pressure signal from the sensor 530, transmits a "stop" signal to the compressor 550, which causes the compressor to stop supplying compressed air to the reservoir 520.

With continued reference to FIG. 8, an air line 580 connects the reservoir 520 with the pneumatic biasing member 440 in order to supply compressed air to the biasing member. The pressure regulator 510 is connected to the air line 580 between the reservoir 520 and the biasing member 440. The input control 512 of the regulator 510 can be manipulated in order to control the internal operating pressure of the biasing member 440. The level of internal operating pressure of the biasing member 440 can correspond to an effective spring rate of the biasing member. That is, a relatively high internal operating pressure can correspond to a relatively high spring rate, while a relatively low internal operating pressure can correspond to a relatively low spring rate. The internal operating pressure of the biasing member 440 can thus be set and/or adjusted as desired by a user in order to affect the response and/or performance of the biasing member. The pressure gauge 570 can be connected to the air line 580 between the regulator 510 and the biasing member 440 in order to indicate the level of internal operating pressure of the biasing member.

Figure 9:
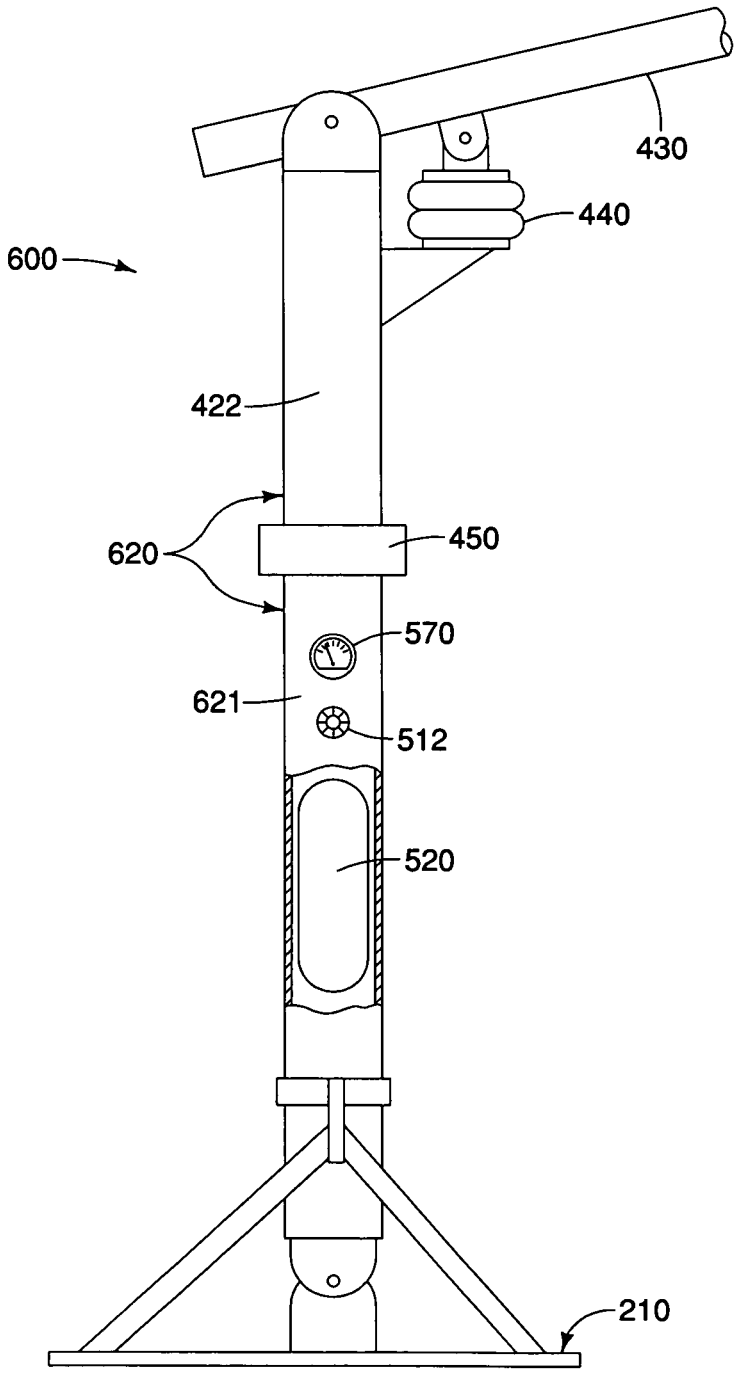
FIG. 9 is a side elevation view of an apparatus according to an alternative embodiment of the present disclosure.

Turning now to FIG. 9, a side elevation view of an apparatus 600 is shown. The apparatus 600 can be substantially similar to the apparatus 400 described herein above with respect to FIG. 6, with the exception of the alternative configuration of the mast, as noted hereinbelow. With reference to FIG. 9, it is seen that the mast 620 can be configured to house and/or support one or more portions of the pneumatic system 500, which is described hereinabove with respect to FIG. 8. That is, one or more components and/or portions of the system 500 can be incorporated into, or can be substantially integral with, the one or more portions of the apparatus 600 (shown in FIG. 9), such as the mast 620. For example, as shown in FIG. 9, the mast lower portion 621 can be adapted to house and/or support one or more of the pressure gauge 570, the regulator input 512, the regulator (not shown), and the pressure reservoir 520. Alternatively, one or more additional components of the system 500 can be incorporated in the apparatus 600. A cutaway of the mast lower portion 621 reveals that the pressure reservoir 520 can be substantially integral with, or can be housed and/or supported within, the mast lower portion. It is to be understood that other components and/or portions of the system 500 (shown in FIG. 8) can be supported by one or more components and/or portions of the apparatus 600 (shown in FIG. 9).

Figure 10:
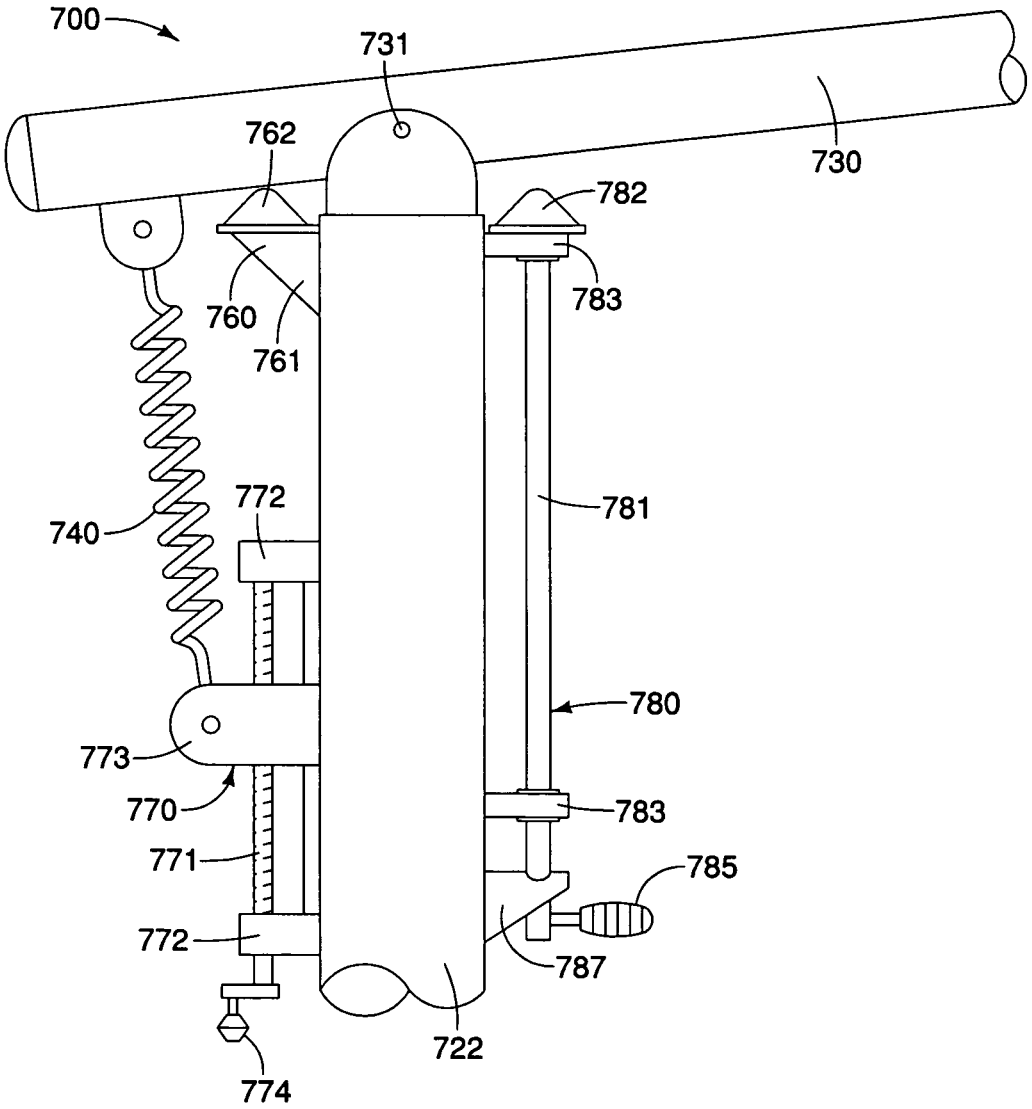
FIG. 10 is a partial side elevation view of an apparatus according to an alternative embodiment of the present disclosure.

Turning now to FIG. 10, a partial side elevation view of an apparatus 700 is shown. The apparatus 700 can be configured, and can be adapted to function, in manners generally similar to those of the apparatus 100 and 200 described herein above with respect to FIGS. 1-3. The apparatus 700 includes a mast upper portion 722 and a boom 730 that is pivotally supported by the upper portion at a pivot joint 731. The mast upper portion 722 supports the boom 730 by way of a pivot joint 731. The apparatus 700 includes a biasing member 740. The exemplary biasing member 740 is adapted to provide a tensile biasing force between the mast upper portion 722 and the boom 730. That is, the exemplary biasing member 740 is adapted to operate primarily under tension.

The apparatus 700 includes an adjustment mechanism 770. The adjustment mechanism 770 is adapted to facilitate selective adjustment of a biasing force that the biasing member 740 applies to the boom 730. The exemplary adjustment mechanism 770 includes a lead screw 771. The lead screw is operatively supported by a pair of bearings 772, which are supported by the mast upper portion 722. The bearings 772 facilitate axial rotation of the lead screw 771. The lead screw is operatively engaged with a movable spring mount 773. That is, the lead screw 771 is threaded through the spring mount 773 so that selective axial rotation of the lead screw causes corresponding selective movement of the spring mount along the lead screw length and between the pair of bearings. Rotation of the lead screw 771 can be achieved by use of a crank handle 774. Thus, an operator or user of the apparatus 700 can selectively manipulate the crank handle to achieve a desired tension or preload of the biasing member 740. According to at least one embodiment of the present disclosure, the adjustment mechanism 770 is placed and/or positioned relative to the mast upper portion 722 in a manner configured to facilitate access to the crank handle 774 by an operator or user who is standing adjacent to the apparatus 700.

The apparatus 700 includes a backstop 760. The backstop 760 is supported by the mast upper portion 722. The backstop 760 is positioned so that the biasing member 740 biases the boom 730 against the backstop while the boom is in a rest position, as depicted. The backstop 760 includes a bracket or mount 761, which is rigidly affixed to the mast upper portion 722. The bracket 761 is preferably made from a rigid or structural material sufficient to withstand forces resulting from impingement of the boom 730 against the backstop 760. The backstop 760 also includes a bumper 762. The bumper 762 is supported by, and affixed to, the bracket 761. The bumper 762 is adapted to contact the boom 730. The bumper 762 is preferably formed from a resiliently deformable or deflectable material such as rubber, or urethane or the like.

With continued reference to FIG. 10, the apparatus 700 includes a vertical stop 780, which is supported on the mast upper portion 722. The vertical stop 780 is adapted to limit movement of the boom 730 about the pivot joint 731. More specifically, the vertical stop 780 is adapted to limit movement of the boom 730 as it is moved away from the rest position, in which the boom is depicted. The vertical stop 780 includes a bumper 782, which is adapted to contact the boom 730 in order to limit movement of the boom. The bumper 782 is preferably formed from a resiliently deformable or deflectable material such as rubber, or urethane or the like.

The vertical stop 780 can be selectively adjustable between a plurality of positions. The exemplary vertical stop 780 is adjustable between a lower position (depicted in FIG. 10) and an upper position. The adjustable vertical stop 780 includes an extension element 781. The extension element 781 can be in the form of an elongated rod or bar or the like. The extension element 781 extends between, and is connected to on opposite ends thereof, the bumper 782 and a handle 785, as depicted in FIG. 10. The extension element 781 is supported in a pair of guides 783. The guides 783 supported by the mast upper portion 722. The guides 783 and the extension element 781 are configured and/or adapted to allow the extension element to slide longitudinally relative to the guides. The guides 783 and the extension element 781 are also configured and/or adapted to allow the extension element to pivot about its length relative to the guides. A bracket 787 is supported on the mast upper portion 722. The bracket 787 is adapted to selectively support the handle 785 in order to hold the handle, the extension element 781 and the bumper 782 in the upper position.

The upper position can be attained by grasping the handle 785 and pushing upward to raise the handle slightly above the bracket 787 before rotating the handle approximately one quarter of a turn before releasing the handle to allow the handle to be supported on the bracket. In this manner, the extension element 781 will be slid upward through the guides so as to raise the bumper 782 to an upper position. According to at least one embodiment of the present disclosure, the adjustable vertical stop 780 is placed and/or positioned relative to the mast upper portion 722 in a manner configured to facilitate access to the handle 785 by an operator or user who is standing adjacent to the apparatus 700.

Figure 11:
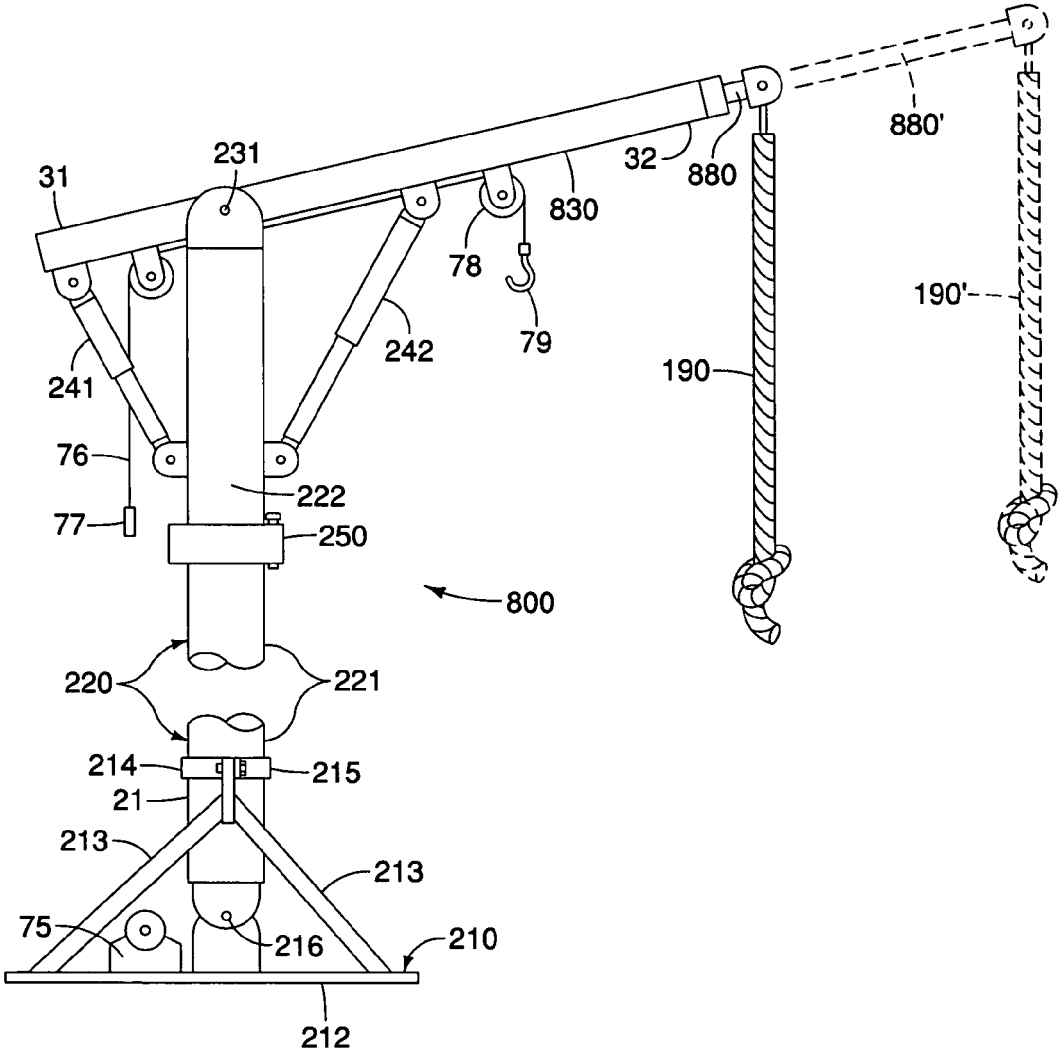
FIG. 11 is a side elevation view of an apparatus according to an alternative embodiment of the present disclosure.

Turning now to FIG. 11, a side elevation view of an apparatus 800 is depicted. The apparatus 800 is substantially similar to the apparatus 200 described above with respect to FIG. 2. With reference to FIG. 11, the apparatus 800 is equipped with an extendable boom 830. Extension of the boom 830 results in repositioning of the gripping element 190 farther away from the mast 220. The exemplary apparatus 800 includes a boom extension element 880. The boom extension element 880 can be adapted to be telescopic with respect to the boom 830. More specifically, the extension element 880 can be configured to fit substantially within the boom 830 so as to be adapted for selective telescopic extension therefrom as is seen from a study of FIG. 11. According to an alternative embodiment of the present disclosure, the extension element 880 is a separate component from the boom 830, and the boom is adapted to receive the extension element in a supported position thereon. That is, the extension element 880 can be configured for selective and alternate placement onto, and removal from, the boom 830.

Figure 12:
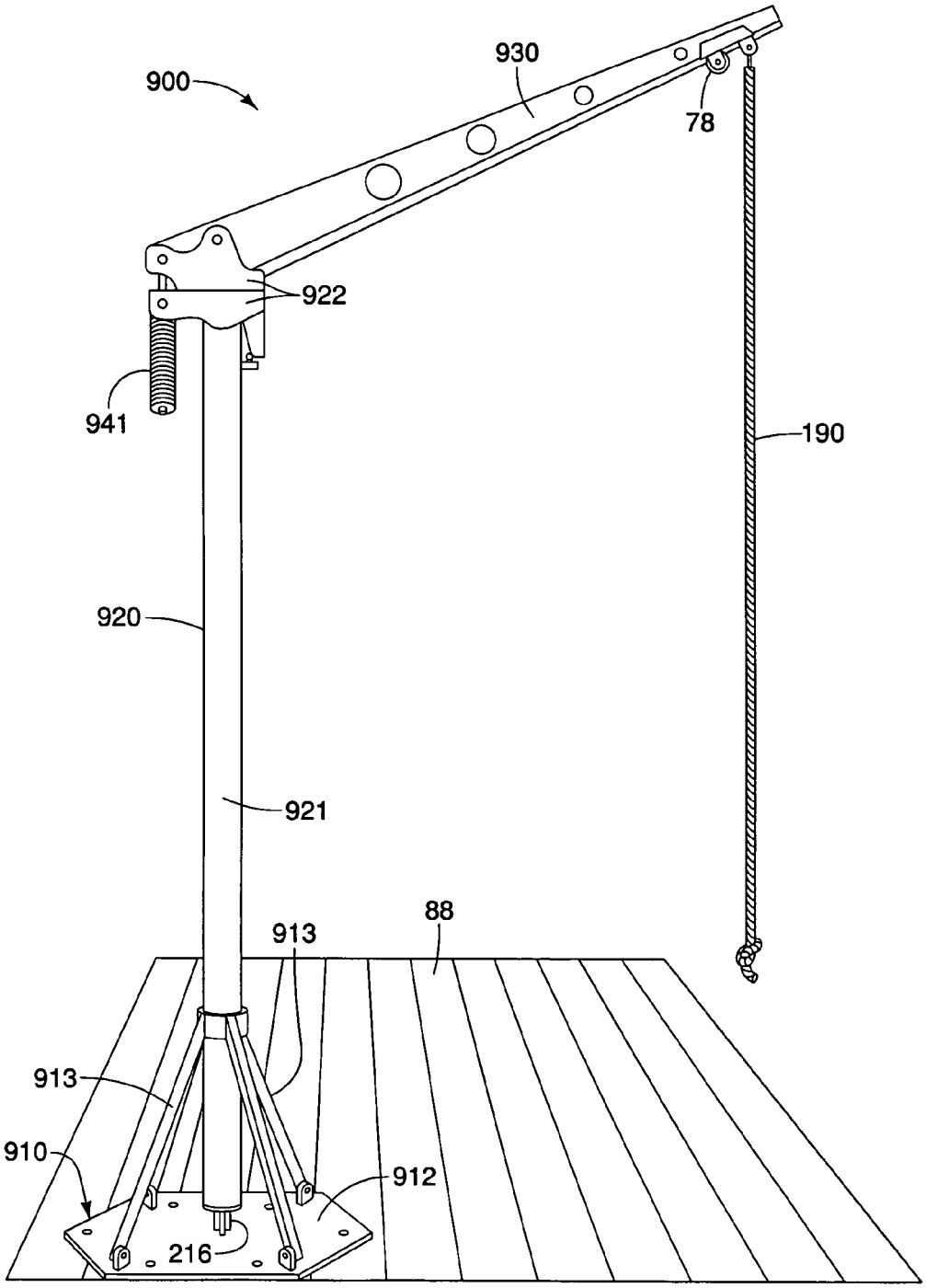
FIG. 12 is an isometric view of an apparatus according to an alternative embodiment of the present disclosure.

Turning now to FIG. 12, an isometric view depicts an apparatus 900 another embodiment of the present disclosure. The apparatus 900 is similar, in general form and function, to other embodiments of the disclosure which are described herein. The apparatus 900 includes a base 910 that can be substantially similar, for example, to the base 210 described herein with respect to FIG. 2. As shown in FIG. 12, the base 910 can include a base plate 912 and one or more braces 913, which can be substantially similar to the base plate 212 and braces 213, respectively, of the apparatus 200. The base 910 is adapted to be mounted on, and/or connected to, a supporting structure 88 such as a dock or raft or the like.

The apparatus 900 includes a mast 920 which is connected to the base plate 912, and which is supported thereby. The mast 920 is connected to the base plate 912 by way of pivot joint 216, which is described above with respect to additional embodiments of the present disclosure. The pivot joint 216 is adapted to allow the mast 920 to be selectively lowered for maintenance and/or stowage in the general manner described herein with respect to other embodiments of the present disclosure. One or more braces 913 also aid in supporting the mast 920. The braces 913 are adapted to be selectively released from the mast 920 for lowering.

The mast 920 includes a lower portion 921 and an upper portion 922. The mast upper portion 922 is pivotally supported by the mast lower portion 921. The mast lower portion 921 is substantially similar to the mast lower portion 221 of the apparatus 200 described hereinabove. The mast upper portion 922 of the apparatus 900 is substantially different in configuration from the mast upper portion 222 of the apparatus 200. A more detailed description of the mast upper portion 922 of the apparatus 900 is provided hereinbelow with respect to additional drawing figures.

With continuing reference to FIG. 12, the apparatus 900 includes a biasing member 941. The biasing member 941 is substantially in the form of a coil spring adapted primarily for compressive deflection. The biasing member 941 is substantially supported by the upper mast portion 922. The biasing member 941 can be substantially similar in function to the biasing member 241 of the apparatus 200, which is described hereinabove with respect to FIG. 2. As shown in FIG. 12, the apparatus 900 includes a boom 930 that is pivotally supported by the mast upper portion 922. The boom 930, with the exception of the specific configuration thereof, can be substantially similar in general form and function, for example, to the boom 230 of the apparatus 200 described hereinabove with respect to FIG. 2. With reference to FIG. 12, the boom 930 of the apparatus 900 is substantially in the form of a tapered, boxed beam. More specifically, the boom 930 has a rectangular cross-section, which decreases dimensionally from one end to the other, as is seen from a study of FIG. 12. The boom 930 can be fabricated substantially from aluminum alloy plate. A gripping element 190 is attached to, and depends from, the boom 930. The apparatus 900 can include provisions for the addition of a winch (not shown), which provisions can include, for example, a pulley or sheave 78.

Figure 13:
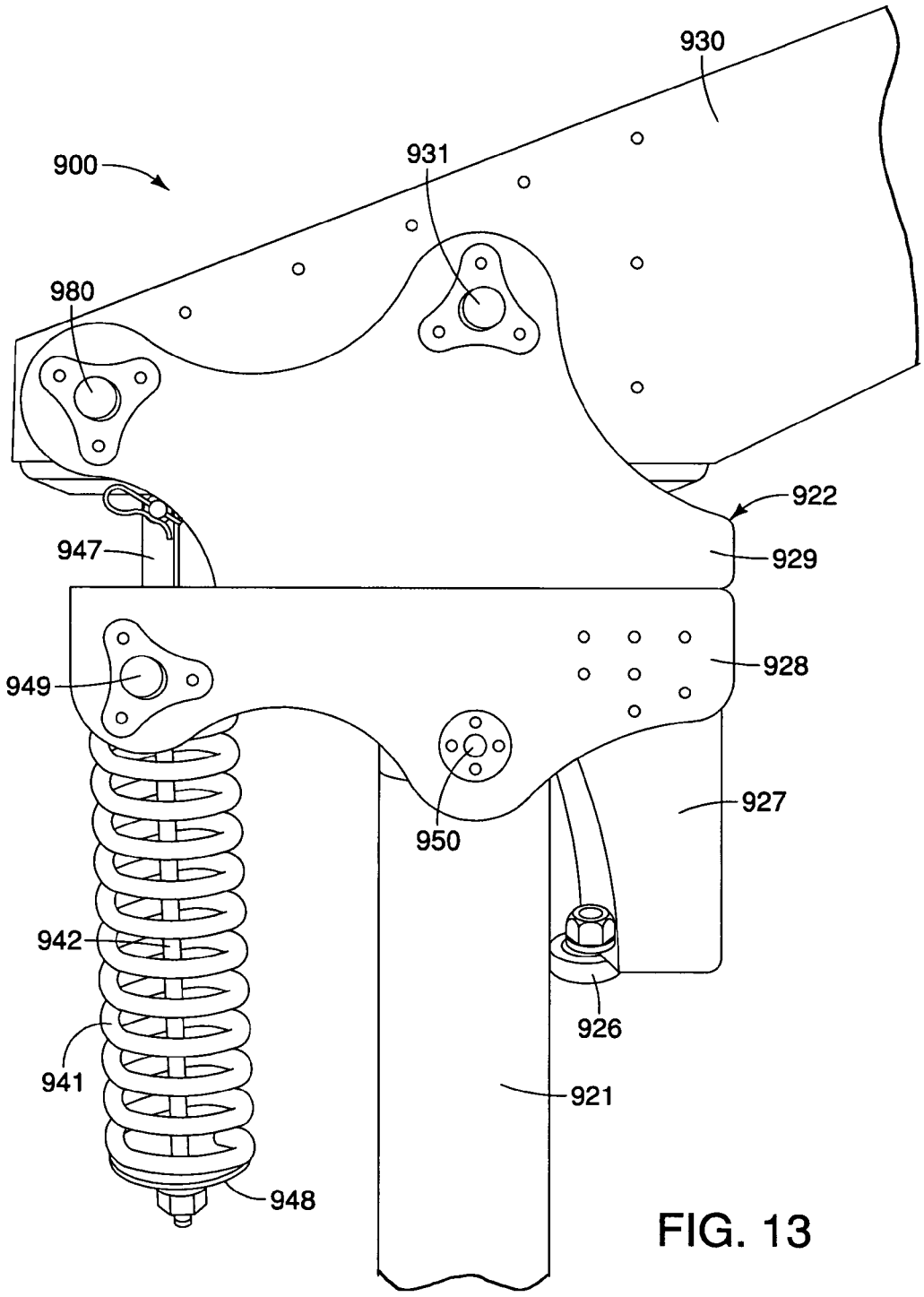
FIG. 13 is an isometric side detail view of the apparatus depicted in FIG. 12.

Turning now to FIG. 13, an isometric side detail view of the mast upper portion 922 of the apparatus 900 is shown. The mast upper portion 922 includes an upper C-channel 929 and a lower C-channel 928. The upper C-channel 929 and the lower C-channel 928 are connected in back-to-back orientation, which is more easily seen from study of additional drawing figures that are described hereinbelow. The boom 930 is supported by the upper C-channel 929 by way of a boom pivot joint 931. The boom pivot joint 931 can be substantially similar to other boom pivot joints described herein, such as the boom pivot joint 231 of the apparatus 200. As seen with reference to FIG. 12, the apparatus 900 includes a vertical limit stop 980 which can be similar to the other vertical limit stops described herein, such as the vertical limit stop 780 of the apparatus 700. The vertical limit stop 980 can be substantially in the form of a pin or shaft that is selectively positionable through the upper C-channel 929 and through at least a portion of the boom 930. The vertical limit stop 980 can function to selectively limit movement of the boom 930 about the boom pivot point 931.

With continued reference to FIG. 13, the apparatus 900 includes a horizontal limit stop 950. The horizontal limit stop 950 can be substantially similar to the limit stops according to the other embodiments of the present disclosure described hereinabove. The horizontal limit stop 950 can be substantially in the form of a pin or shaft that is selectively positionable through the lower C-channel 928 and through at least a portion of the mast lower portion 921. The horizontal limit stop 950 can function to selectively limit movement of the mast upper portion 922 relative to the mast lower portion 921. The apparatus 900 includes a bearing bracket 927 which is connected to and substantially supported by the lower C-channel 928. The bearing bracket 927 extends substantially downward from the lower C-channel 928. A lower bearing 926 is also included in the apparatus 900. The lower bearing 926 is supported by the bearing bracket 927, as shown. The lower bearing 926 can be substantially in the form of a roller bearing that is adapted to operatively bear against, and in rolling engagement with, the mast lower portion 921. The bearing bracket 927 can serve to support thereon a winch (not shown) in the event that a winch is employed for use in conjunction with the apparatus 900.

Still referring to FIG. 13, the apparatus 900 includes a biasing member shaft 940 that passes through at least a portion of the lower C-channel 928 and which is pivotal with respect thereto. The apparatus 900 includes a pull rod 942 that passes through the biasing member shaft 940 and also passes through the length of the biasing member 941, as shown. A spring retainer 948 is fastened to the lower end of the pull rod 942, as shown. The spring retainer 948 can be, for example, substantially in the form of a round plate or the like. As a study of FIG. 13 reveals, the biasing member 941 surrounds the pull rod 942, and the biasing member is also captured between the spring retainer 948 and the biasing member shaft 949. The upper end of the pull rod 942 is connected to a clevis 947, which is pivotally connected to the boom 930. Thus, rotation of the boom 930 in a clockwise direction about the boom pivot joint 931 will result in the pull rod 942 moving upward through the biasing member shaft 949, which will cause the biasing member 941 to be compressed between the biasing member shaft and the spring retainer 948. This action of the biasing member 949 tends to bias the position of the boom 930 toward a rest position of the boom, which is depicted in FIGS. 12 and 13. The rest position of the boom 930 is one in which no significant external load is acting on the boom.

Figure 14:
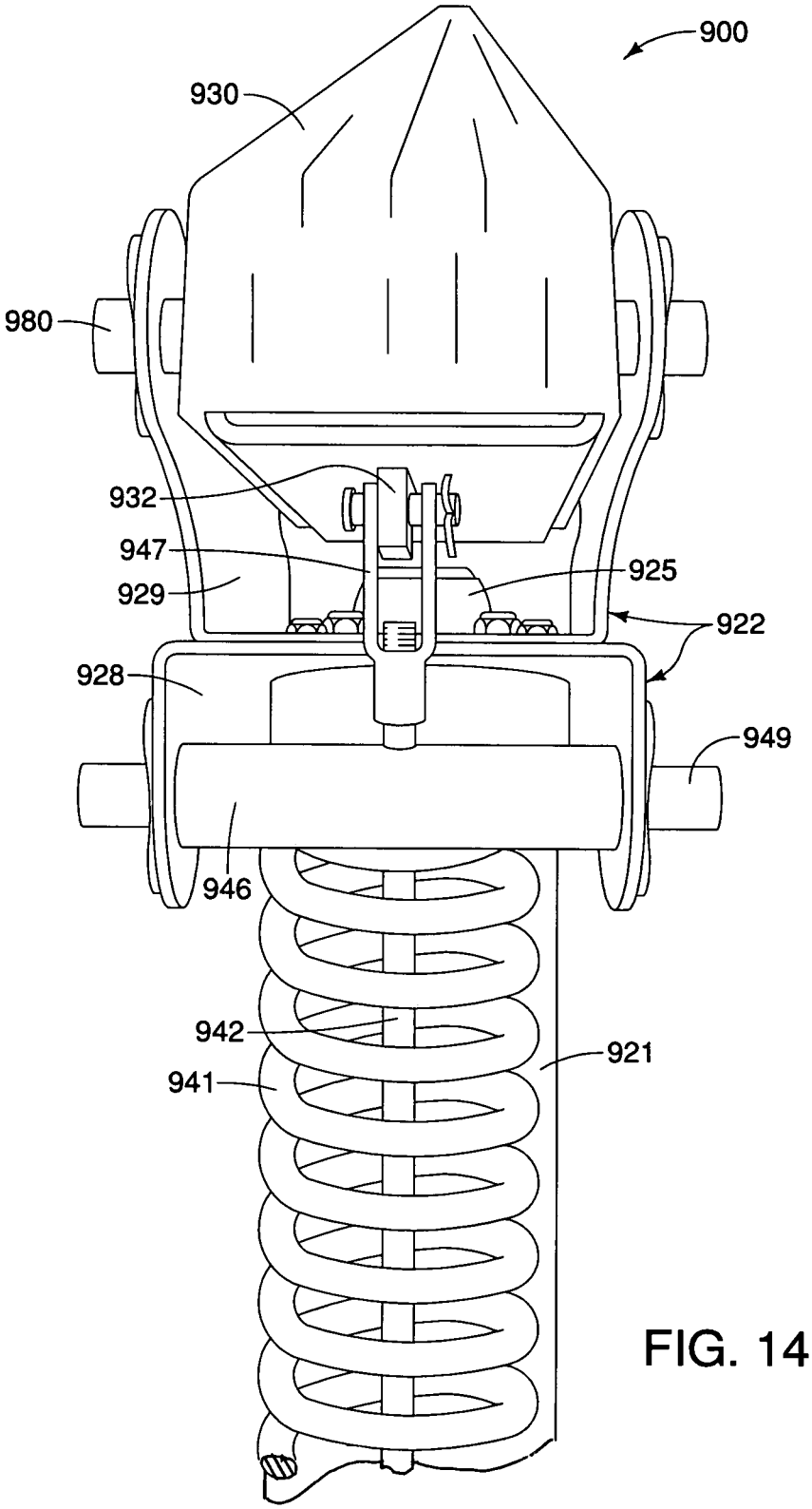
FIG. 14 is an isometric end detail view of the apparatus depicted in FIG. 12.
Figure 15:
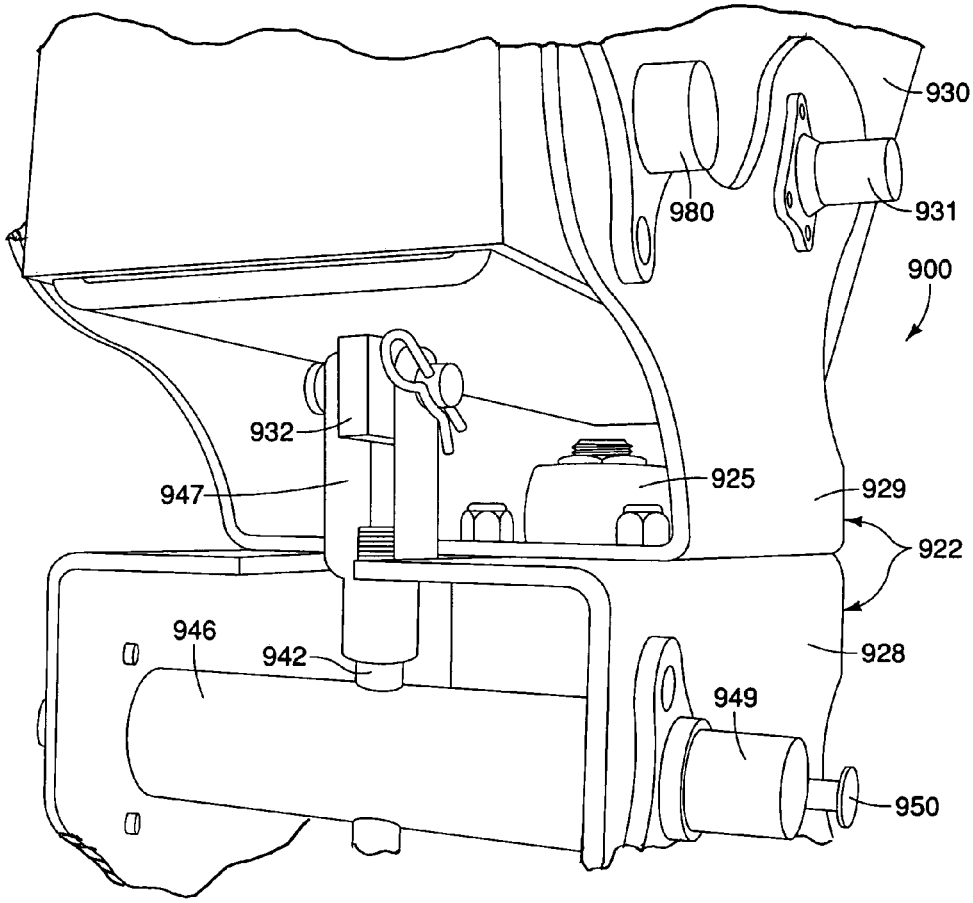
FIG. 15 is an isometric quarter detail view of the apparatus depicted in FIG. 12.

Now referring to FIGS. 14 and 15, an isometric detail end view and a detail quarter view of the mast upper portion 922 of the apparatus 900 are shown, respectively. The apparatus 900 includes an upper bearing 925. The upper bearing 925 can be substantially similar to one or more upper bearings of the other embodiments of the present disclosure described hereinabove, such as upper bearing 225 described with respect to FIG. 4. According to the exemplary embodiment of the apparatus 900, the upper bearing 925 is a typical automotive road wheel hub/bearing assembly of appropriate size, such as a small automotive utility trailer hub. With reference to FIG. 14, the upper bearing 925 is supported by the mast lower portion 921. The mast upper portion 922 is supported, at least in part, by the upper bearing 925. The mast upper portion 922 can be fastened to the upper bearing 925, as depicted. As is also depicted, the mast upper portion 922 includes the upper C-channel 929 and the lower C-channel 928. The views provided by both FIG. 14 and FIG. 15 readily depict the aforementioned back-to-back orientation of the upper C-channel 929 and the lower C-channel 928.

With continued reference to FIGS. 14 and 15, the apparatus 900 includes a sleeve 946 through which the biasing member shaft 949 is disposed. As is depicted, the pull rod 942 is slidably disposed through both the sleeve 946 and the shaft 949 by way of corresponding passages or apertures defined in the sleeve and the shaft. As is further depicted, the pull rod 942 transversally oriented relative to the biasing member shaft 949 and relative to the sleeve 946. According to the exemplary embodiment of the present disclosure, the clevis 947 is threaded onto the upper end of the pull rod 942. The clevis 947, in turn, is pivotally connected to a lug 932, which is affixed, such as by welding, to the boom 930, as shown. In this manner, movement of the boom 930 about the boom pivot joint 931 (shown in FIG. 15) in a given direction results in application of an upward force on the pull rod 942. Such application of upward force on the pull rod 942 results in compression of the spring 941 (shown in FIG. 14). The vertical limit stop 980 is also shown in FIGS. 14 and 15 along with the horizontal limit stop 950 (shown in FIG. 15).

Figure 16:
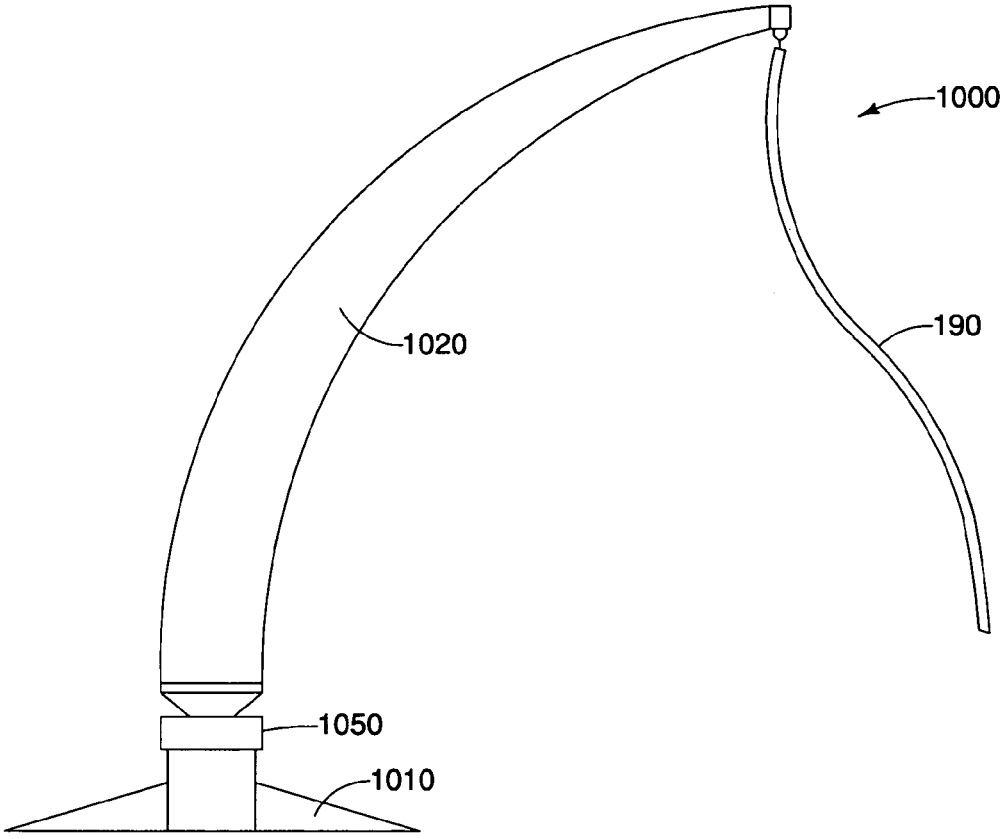
FIG. 16 is a side elevation view of an apparatus according to an alternative embodiment of the disclosure.

Turning now to FIG. 16, a side elevation view depicts a recreational swing apparatus 1000 according to an alternative embodiment of the present disclosure. The apparatus 1000 can be substantially similar to the other various embodiments of the apparatus described herein with respect to general configuration and function. The apparatus 1000 includes a base 1010, which can be substantially similar to other bases described and depicted herein, such as for example, the base 110 described hereinabove with respect to FIG. 1. With reference to FIG. 16, the base 1010 is configured to support a mast 1020. The apparatus 1010 includes a bearing 1050, which is operatively disposed between the base 1010 and the mast 1020. The bearing 1050 can be configured, in function and construction, to at least a portion of the bearings associated with the other embodiments of the apparatus described herein with respect to FIGS. 1-15. For example, the bearing 1050 is adapted to enable to mast 1020 to pivot relative to the base 1010. The apparatus 1000 includes a gripping element 190 that is attached to, and depends from, the mast at a location thereon distal from the bearing 1050.

With continued reference to FIG. 16, the mast 1020 is configured to incorporate multiple functions, each of which is associated with one of a plurality of components of the other embodiments of the apparatus described with respect to FIGS. 1-15. More particularly, and with reference to FIG. 16, the mast 1020 is configured to incorporate the functions of a mast, a boom and a biasing member. The mast 1020 has a substantially arcuate form. According to the exemplary embodiment of the disclosure depicted in FIG. 16, the mast 1020 is substantially in the form of an arc that is roughly a quarter of a circle. The mast 1020 tapers from a relatively large cross-section proximate the bearing 1050 to a relatively small cross-section proximate the gripping element 190. A study of FIG. 16 reveals that the mast 1020 has a substantially vertical orientation proximate the bearing 1010 and a substantially horizontal orientation proximate the gripping element 190. More particularly, the mast 1010 transitions from a substantially vertical orientation at one end thereof to a substantially horizontal orientation at an opposite end thereof. In this manner, the mast 1010 serves or functions as both a mast and a boom.

The mast 1010 can be substantially resiliently deflectable along at least a portion of its length according to at least one embodiment of the present disclosure. More particularly, the mast is adapted to resiliently deflect in response to an external force acting upon it, such as when a load is placed upon the gripping element 190. By way of example only, the mast 1020 can be configured to resiliently deflect in the manner of an elongated leaf spring that is substantially anchored to the base 1010 by way of the bearing 1050. In this manner, the mast 1020 serves or functions as a biasing member. Thus, it is understood that the mast 1010 can serve or function as a mast and a boom and a biasing member. More particularly, the mast 1010 can be and function as an integrated unitary member that incorporates characteristics and/or functionalities from each of a mast, a boom and a biasing member.

We claim:

1. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and wherein the biasing member comprises a first biasing member adapted to provide primarily a tensile biasing force and a second biasing member adapted to provide primarily a compressive biasing force.

2. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and wherein the mast comprises a stationary lower portion and an upper portion supported by the lower portion and adapted for rotation about the first axis along with the boom, and wherein the apparatus further comprises a lower bearing and an upper bearing, each of which is adapted to support the upper mast portion for rotation about the lower mast portion.

3. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and a vertical limit stop adapted to limit downward movement of the second end of the boom, wherein the limit stop is adapted to be selectively adjusted between a first position in which movement of the boom is substantially prevented, and a second position in which movement of the boom is enabled.

4. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and a horizontal limit stop adapted to limit movement of the boom about the first axis of rotation, wherein the stop comprises a deformable member adapted to reduce severity of movement stoppage about the first axis of rotation.

5. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and a horizontal limit stop adapted to limit movement of the boom about the first axis of rotation, wherein the stop comprises:

an array of stop positions each corresponding to a respective rotational position of the boom about the first axis;

a selectively movable stop element adapted to be placed at one of the stop positions; and a prime member adapted to contact the stop element, wherein said contact defines a limit of movement of the boom.

6. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and a horizontal limit stop adapted to limit movement of the boom about the first axis of rotation, wherein the stop comprises:

an array of stop positions each corresponding to a respective rotational position of the boom about the first axis;

a selectively movable stop element adapted to be placed at one of the stop positions;

a prime member adapted to contact the stop element, wherein said contact defines a limit of movement of the boom; and a deformable member adapted to reduce severity of contact between the prime member and the stop member.

7. A recreational swing apparatus, comprising:

an elongated mast adapted for substantially vertical operational orientation, having a lower end and a distal upper end;

an elongated boom adapted for substantially horizontal operational orientation, and supported by the mast proximate the upper end thereof and adapted to pivot independently about a first axis and a second axis, wherein the first axis is substantially vertical and the second axis is substantially horizontal, and wherein the boom has a first end proximate the mast and an opposite second end distal from the mast;

a gripping element depending from the boom proximate the second end thereof, wherein the gripping element is adapted to be gripped by a user of the apparatus while the user is supported thereby;

a substantially elastic biasing member operatively attached to the mast and to the boom, and adapted to provide a biasing force to bias the boom toward a rest position and against downward movement of the second end, wherein the biasing member is adapted to allow a temporary downward movement of the second end of the boom due to sudden application of weight of a user's body when the user grasps the gripping element; and wherein at least a portion of the mast is substantially resiliently deflectable and substantially arcuately shaped, whereby the boom, the biasing member and at least a portion of the mast are integrated into a unitary member.

* * * * *